United States Patent [19]

Beatty et al.

[11] 4,087,860

[45] May 2, 1978

[54] SYSTEM FOR MULTI-MODE CONTROL OF A BOILER FEEDPUMP TURBINE

[75] Inventors: John M. Beatty, Prospect Park; Robert L. Frater, Aston, both of Pa.

[73] Assignee: Westinghouse Electric Corp., Pittsburgh, Pa.

[21] Appl. No.: 814,055

[22] Filed: Jul. 8, 1977

[51] Int. Cl.[2] ..... F01D 17/06; G05B 11/06

[52] U.S. Cl. ..... 364/494; 60/656; 60/676

[58] Field of Search ..... 235/151.21, 151.31, 235/151; 60/656, 676, 660, 664, 666–667

[56] References Cited

U.S. PATENT DOCUMENTS

| | | | |
|---|---|---|---|
| 3,068,653 | 12/1962 | Driscoll | 60/656 |
| 3,457,725 | 7/1969 | Schwarzenbach | 60/676 |
| 3,845,628 | 11/1974 | Bronicki et al. | 60/656 |

*Primary Examiner*—Edward J. Wise
*Attorney, Agent, or Firm*—W. E. Zitelli

[57] ABSTRACT

A boiler feedpump turbine (BFPT) control system for controlling the rotating speed of a boiler feedpump turbine in a selected one of at least three control modes is disclosed. The boiler feedpump turbine is mechanically coupled to a boiler feedpump for governing the flow of feedwater pumped by the feedpump to a boiler. A boiler control turbine speed signal which represents the feedwater requirement of the boiler is provided to the BPFT control system from a conventional boiler feedwater control system. The flow of feedwater pumped by the feedpump is a function of the rotating speed of the boiler feedpump turbine which is controlled in a selected one of three modes in accordance with the adjustment of a speed set point. The three control modes include adjusting the speed set point in relation to a turbine speed demand signal generated within the BFPT control system only at values below the boiler control turbine speed signal, adjusting the speed set point in relation to the boiler control turbine speed signal, and overriding the adjustment of the speed set point by the boiler control turbine speed signal to permit adjustment of the speed set point by the turbine speed demand signal beyond the value of the boiler control turbine speed signal. Transfers between the control modes are performed automatically in response to a set of predetermined conditions and commands. The BFPT additionally provides for conducting an overspeed test which permits adjustment of the speed set point by the turbine speed demand signal in a predetermined range beyond a rated turbine speed value. This overspeed test function prohibits the speed set point from remaining above the rated turbine speed values at times when not conducting the overspeed test. The BFPT control system employs a closed-loop primary speed controller which calculates its turbine speed feedback signal from a selected one of two speed transducers. The other of the two speed transducers may be used if a malfunction is detected in the selected speed transducer. The BFPT control system further incorporates a degraded manual backup controller which assumes control responsibilities when a malfunction is detected which renders the primary controller inoperative.

22 Claims, 12 Drawing Figures

SYSTEM FOR MULTI-MODE CONTROL OF A BOILER FEEDPUMP TURBINE

BACKGROUND OF THE INVENTION

1. Field of the Invention

This invention relates to boiler feedpump turbine systems in general, and more particularly, to an electronic multiple-mode boiler feedpump turbine control system.

2. Description of the Prior Art

Generally, the boiler feedpump turbine systems are considered a part of the overall boiler feedwater supply system and are normally controlled as part of a conventional boiler feedwater control system. The boiler feedpump turbine is usually mechanically connected to and drives a boiler feedwater pump with a common shaft and the amount of water typically pumped by the feedwater pump from a feedwater source to the boiler is usually a function of the rotational speed of the boiler feedpump turbine. Normally, the boiler feedwater pump requirements are coordinated with the speed and load demands of the main turbine system which conducts the steam discharged by the boiler at controlled rates. In many cases, high and low pressure steam sources for the boiler feedpump turbine are supplied from the main steam header and extraction points of the main turbine system. Steam admission valves govern the speed of the boiler feedpump turbine by controlling the rate of steam admission to the boiler feedpump turbines as a function of their position settings. In most boiler feedpump turbine systems, there exists an independent boiler feedpump turbine control system for controlling under closed-loop conditions the speed of the feedpump turbine in an outer loop and the position of the steam admission valves in an inner loop.

One known type of boiler feedpump turbine control system presently offers only two modes of controlling the rotational speed of the feedpump turbine. A first mode permits an operator to control a speed reference set point using increase and decrease pushbuttons on an operator's panel to adjust the output voltage potential of a motor driven potentiometer whereby the voltage potential is representative of the speed reference set point. The rotational speed of the feedpump turbine is controlled in this first mode in a speed range from turning gear speed to a predetermined initial speed suitable for driving the boiler feedpump turbine. In this known system, the rotational speed control of the boiler feedpump turbine is transferred to a boiler control speed signal which is supplied from a conventional feedwater control system when the speed reference set point is initially adjusted equal to a predetermined initial speed value. Control of the rotational speed of the turbine using the boiler control speed signal is considered the second mode of control. After transfer to this second mode of control, the motor driven potentiometer is driven to one side to output a maximum voltage potential. A low select circuit within the control system ensures the continuous selection of the boiler control speed signal thereafter; thus, subsequent to the transfer, the boiler feedpump turbine control system is governed by the boiler control speed signal.

There are certain undesirable features of this type of control system relating to the boiler control signal interface. First of all, there is no automatic detection of an invalid boiler control speed signal. Such an anomaly must presently be detected by a power plant operator usually as a result of observing a disturbance in the operation of the steam supply subsystem of the main boiler/turbine system. In some cases, where the boiler control speed signal fails instantaneously to a state which either demands zero pumping capacity or full pumping capacity, a catastrophic disturbance in the steam supply subsystem may occur of such proportions to affect a trip condition in the main boiler/turbine system thus rendering the system unavailable to produce power. In addition, these present type feedpump control systems offer no limitation to the rate of change in the boiler control speed signal. The rotational speed of the boiler feedpump turbine presently follows any large instantaneous perturbations in the boiler control speed signal and the acceleration of the boiler feedpump turbine is only limited by its inertia and other minor secondary damping factors based on speed. It is understood that turbine acceleration disturbances of this nature will normally occur only occasionally as a result of a contingent electrical noise disturbance in the boiler control speed signal without causing any substantial deleterious effects on the boiler feedpump turbine. However, should a periodic electrical noise disturbance be coupled to the boiler control speed signal, the feedpump turbine may cycle at undesirable accelerations continuously. Due to the periodic nature of the speed changes, there is a possibility that this type of disturbance may go undetected by an operator thereby causing a trip condition to occur which may again render the main boiler/turbine system unavailable as a result of a forced shutdown.

Further, these present type boiler feedpump turbine control systems offer no convenient method for permitting the power plant operator to control the speed of the feedpump turbine across the speed range from 0% to 100% of the rated speed value. Also, no on-line control is presently available to the operator in these type systems to permit overriding the boiler control speed signal supplied by the boiler feedwater control system. In addition, these known systems offer no secondary control systems such as manual control of the valve positions to back up the primary closed-loop speed control system. Such a manual backup valve position controller may allow for a gradual, controlled and planned shutdown of the main boiler/turbine system as a result of certain malfunctions in the boiler feedpump turbine controller which will eliminate in some instances the undesirable forced outages brought on by an instantaneous trip situation. Still further, these present type systems provide only one speed pick-up for the purposes of measuring speed and supplying the speed feedback signal to the closed-loop speed controller. It is apparent that loss of this feedback speed signal due to a failure in the pick-up, for example, will usually cause the turbine to trip as a result of a boiler feedpump turbine overspeed situation.

Presently, it is necessary, in most cases, to operate the boiler feedpump turbines in an unorthodox manner to affect a speed greater than the rated speed of the boiler feedpump turbine for purposes of calibrating and periodic testing of a conventional mechanical overspeed trip weight. In these systems, there are no provisions to permit the operator to conveniently control the turbine speed above the rated turbine rotational speed. In some instances, calibration and testing of the trip weight are done using make-shift modifications to the valve actuator portions of the hydraulic system independently of the boiler feedpump turbine electronic controller.

These unorthodox operations consume a great deal of time which could normally be spent more productively.

It appears that improvements to the present type boiler feedpump turbine systems comprising monitoring and detecting anomaly conditions in the boiler feedwater control and reverting to alternative speed and valve position control options are desirable in decreasing the possibility of forced outages of the main boiler/turbine systems in some cases. Operator speed control conveniences and redundancy in essential signals and control subsystems may further enhance the availability and controlability of the boiler feedpump turbine systems. The present invention provides for these and other features to improve the overall control, protection and ultimate availability of the boiler feedpump turbine system.

SUMMARY OF THE INVENTION

In accordance with the present invention, a boiler feedpump turbine (BFPT) system controls the rotational speed of a BFPT in one of at least three control modes as a function of a speed set point generated therein. The boiler feedpump turbine is mechanically coupled to a boiler feedpump for governing the flow of feedwater pumped thereby as a function of the rotational speed of the BFPT. More specifically, the control modes include a first mode wherein the speed set point is controlled as a function of a turbine speed demand signal only when the speed set point value is below a boiler control turbine speed signal which is representative of the boiler control requirement for feedwater flow, a second mode wherein the speed set point is controlled as a function of the boiler control turbine speed signal, and a third mode wherein the speed set point is controlled by the turbine speed demand signal to override the boiler control turbine speed signal. Transfers between the control modes are performed automatically in response to the logical states of a set of predetermined conditions and commands in relation to the BFPT system without causing significant disturbance in the boiler feedpump turbine speed.

The BPFT system includes a function which limits the value of the speed set point to a rated turbine speed value and a function which regulates the rate of change of the boiler control turbine speed signal while operating in the second control mode.

The BPFT system additionally includes an overspeed test function which when enabled affects a transfer of control to the third or override mode and permits control of the turbine speed in a predetermined range above the rated speed value for testing of either an electrical or mechanical overspeed trip mechanism. Should the speed set point be left at a value above the rated speed value at a time when the overspeed test is disabled, the BFPT system provides for decreasing the speed set point at a predetermined rate to a value substantially equal to the rated speed value. Thus, the BFPT system prohibits the speed set point value from remaining above the rated speed value at times when not conducting an overspeed test.

The BFPT further includes a closed-loop primary speed controller wherein a signal representative of the actual speed of the BFPT is calculated from speed pulses extracted from a selected one of two speed transducers. Speed pulses may be extracted from the other of the two speed transducers should a malfunction be detected in the selected speed transducer. Indications are provided in the event of a malfunction of either of the two speed transducers.

The BFPT still further includes a degraded manual backup controller which accepts transfer of control thereto from the primary turbine speed controller in response to a detected malfunction which renders the primary controller inoperative. The transfer to the manual controller is performed with no substantial effects on the rotational speed of the turbine.

DESCRIPTION OF THE PREFERRED EMBODIMENT

Figure 1:
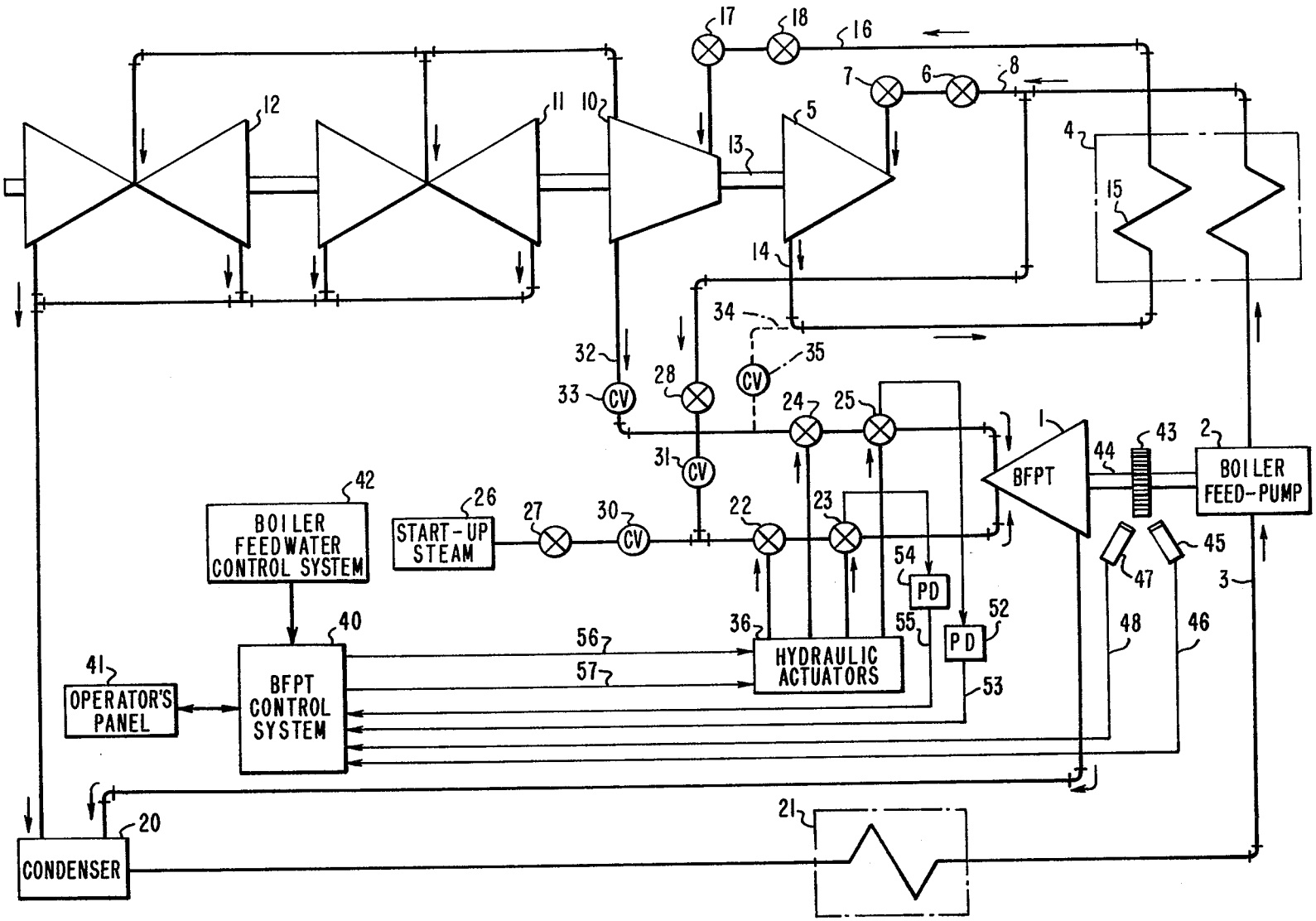
FIG. 1 is a functional block diagram schematic of a boiler/turbine steam supply system incorporating the present invention.

In a typical boiler/turbine steam system as shown in FIG. 1, a boiler feedpump turbine (BFPT) 1 is axially coupled to a boiler feedpump 2 for driving the boiler feedpump 2 to pump water from a feedwater line 3 to a conventional steam boiler 4. The boiler 4 converts the feedwater into steam which is conducted therefrom to a high pressure (HP) turbine section 5. Normally, throttle and governor valves 6 and 7, respectively, are disposed in a steam line 8 between the boiler 4 and HP turbine section 5 for the control of the steam passing therethrough. Additional turbine sections such as an intermediate pressure (IP) turbine section 10 and one or more low pressure (LP) turbine sections 11 and 12 may be axially connected to the HP turbine section with a common shaft 13. Steam exiting from the HP turbine section 5 is typically returned to the boiler 4 using the cross-under steam piping 14 for the purposes of reheating the steam in a reheater section 15 of the boiler 4. The reheated steam is conducted to the inlet of the IP turbine section 10 through the cross-over piping 16. Interceptor valves 17 and reheat stop valves 18 may be used to modulate the steam from the reheater section 15 to the IP turbine section 10. Steam exiting from the IP turbine section 10 usually enters the inputs to the one or more LP turbine sections 11 and 12 and is exhausted therefrom to a condenser 20 to be reconverted into water. The condenser water is generally reheated with a plurality of feed water heaters 21 and recycled to the boiler 4 at a rate determined by the boiler feedpump 2. The rate of water pumped by the feedpump 2 is normally a function of the rotational speed of the boiler feedpump turbine 1 driving it.

The rotational speed of the boiler feedpump turbine 1 is controlled by the amount of steam admitted thereto. High pressure steam admitted to the boiler feedpump turbine 1 is generally governed by a set of high pressure stop valves and high pressure governor valves 22 and 23 respectively. Low pressure steam admitted to the boiler feed pump turbine 1 is generally governed by a conventional set of low pressure stop valves 24 and low pressure governor valves 25. High pressure steam admitted to the boiler feedpump turbine may come from either of two sources: the main steam header 8 which is the output of the boiler or from a start-up steam source such as an auxiliary boiler 26. Valves 27 and 28 may control the selection of the high pressure steam source to the boiler feedpump turbine 1. Check valves 30 and 31 are included in the high pressure steam lines to the boiler feedpump turbine as an added precaution in isolating the two sources. The low pressure steam source is normally taken from an extraction line 32 from the intermediate pressure turbine 10 and a check valve 33 is included to prohibit any water formation from backing into the intermediate pressure turbine 10. In those turbine building blocks which exclude the intermediate pressure turbine 10, an alternate source of low pressure steam may come from the exhaust line 14 of the high pressure turbine 5 as shown by the dotted line 34 in FIG. 1. A check valve 35 is also included in line 34 to prohibit water from backing into the steam exhaust line 14.

Conventional hydraulic actuators 36 are used to position the steam control valves 22, 23, 24, and 25. The high pressure stop valves 22 and low pressure stop valves 24 are normally actuated in either an open or a closed state. The high pressure governor valves 23 and low pressure governor valves 25 are modulated to govern the steam admission to the boiler feedpump turbine. A boiler feedpump turbine control system 40 is used to control the rotating speed of the boiler feedpump turbine 1 as governed by a speed set point adjusted from either an operator's panel 41 or a conventional boiler feedwater control system 42. Two closed loop controllers are normally used in conventional boiler feedpump turbine control systems. One is used for speed control and one is used for steam admission valve position control. The rotating speed of the boiler feedpump turbine 1 is generally measured using a toothed wheel 43 coupled to the boiler feedpump turbine shaft 44 whereupon a magnetic speed pickup 45 coupled adjacent to the toothed wheel produces a speed pulse with each passing occurrence of a tooth of the toothed wheel 43. These speed pulses are transmitted to the boiler feedpump turbine control system 40 over signal line 46. A redundant magnetic speed pickup 47 is included and transmits its speed pulses over signal line 48 to the boiler feedpump control system 40. The speed measurement resulting from one of either the speed pulses of signal path 46 or signal path 48 may be used as a speed feedback signal to be subtracted from the speed set point resulting in a speed error. This speed error is operated on by a speed controller function within the boiler feedpump turbine control system 40 to generate a position set point. This position set point, for the purposes of this embodiment, is used to control the positions of both the high pressure governor valves 23 and the low pressure governor valves 25.

The actual position of the low pressure governor valves 25 is detected by a position detector 52 generally of the LVDT type. The measured position signal is transmitted back to the boiler feedpump turbine control system 40 over signal line 53. The position of the high pressure governor valve 23 is monitored by a position detector 54 which may also be of the LVDT type and a signal representative of the actual position of the high pressure governor valves 23 is transmitted to the boiler feedpump turbine control system 40 over signal line 55. The measured position signal 53 is subtracted from the position set point generated within the boiler feedpump turbine control system to produce a position error for the low pressure governor valves 25. A low pressure governor valve position controller operates on this position error to produce a signal 56 to control the hydraulic actuator associated with the low pressure governor valves 25 to bring the position of the low pressure governor valves to that of the adjusted position set point. In addition, the measured position of the high pressure governor valves is also subtracted from the position set point to produce a position error which is operated on by another position controller to affect another hydraulic actuator control signal 57 to control the hydraulic actuator associated with the high pressure governor valves 23 to position them to the position set point. In some systems the position controllers of the high pressure governor valves are offset such that they are not expected to open until the position set point increases to a value of say 40 or 50%. The position controller gain in these cases, of course, are set such that the high pressure governor valves 23 are full open by the time the value of the position set point reaches 100%.

A typical operation of the boiler feedpump feedwater system may be initiated by opening valve 27 and closing valve 28 to allow startup steam to be conducted from the startup steam source 26 through valve 27, check valve 30 to the high pressure stop valve 22. The high pressure stop valve may be full opened through controls from the operator's panel 41. At this time it is well to note that no water is being pumped into the boiler, therefore there is no steam being generated through the high pressure turbine section 5 or the intermediate pressure turbine section 10 so there is essentially no steam produced in the lines 32 or the alternate line 34. The boiler feedpump turbine is being operated by a turning gear starting motor at about 3 to 6 rpm rotational speed. The operator will normally set a nominal speed demand of around 5 or 10% of rated speed of the boiler feedpump turbine and control the high pressure stop valves wide open. The speed error produced within the boiler feedpump turbine control system 40 governs the positions of the low pressure governor valves 25 and high pressure governor valves 23 such to permit steam admission to the boiler feedpump turbine 1 to increase the rotational speed of the boiler feedpump turbine 1 to the value of the speed set point adjusted through the operator's panel 41. Since the low pressure governor valves 25 are ineffective because there is no existing low pressure steam, the low pressure governor valves 25 are controlled wide open and the high pressure governor valves 23 are controlled to a position to allow high pressure steam from the auxiliary source 26 to increase the rotational speed of the boiler feedpump turbine 1.

As the rotational speed of the boiler feedpump turbine 1 increases to 5 or 10% of rated speed, the boiler feedpump will start pumping water at a rate controlled by the rotational speed of the feedpump turbine 1 into the boiler 4. The boiler 4 will start converting the water to steam which will under proper conditions be admitted through the high pressure turbine section 5 and subsequently through the reheater 15 and intermediate pressure turbine section 10 and so on through the low pressure turbine sections 11 and 12 to the condenser 20. As the amount of low pressure steam increases, steam will be extracted from the intermediate pressure turbine section 10 through steam line 32 and check valve 33 to the low pressure governor valve 25. The contribution of this low pressure steam has the effect of increasing the speed of the boiler feedpump turbine 1 beyond that which is set by the speed set point. The speed error created as a result thereof causes the position set point to decrease, thus the high pressure governor valves 23 start to close to eliminate the contribution of high pressure steam coming from the startup auxiliary source 26. During this time, of course, the pressure at the throttle exit 8 of the boiler 4 will be built up sufficient for use as the high pressure steam source for the boiler feedpump turbine 1. When the low pressure steam source from steam line 32 is sufficient to individually control the rotational speed of the boiler feedpump turbine 1 at the speed set point, the high pressure governor valves 23 will be essentially fully closed. At this time, the valve 27 may be fully closed and the valve 28 fully open, thus permitting high pressure steam to flow from the throttle header 8 instead of the auxiliary steam source 26.

The rotational speed of the boiler feedpump turbine 1 may hereafter be controlled by the generation of a new speed set point through use of the operator's panel 41. The operator may control the rotational speed of the boiler feedpump turbine 1 until the value of the speed set point initially equals a boiler control turbine speed signal value generated by the boiler feedwater control system 42. Subsequently, the rotational speed of the boiler feedpump turbine 1 is controlled by the boiler feedwater control system 42 utilizing this boiler control turbine speed signal. Thus, the rate of feedwater being pumped into the boiler 4 by the boiler feedpump 2 is controlled by the boiler feedwater control system 42 thereafter.

Figure 2:
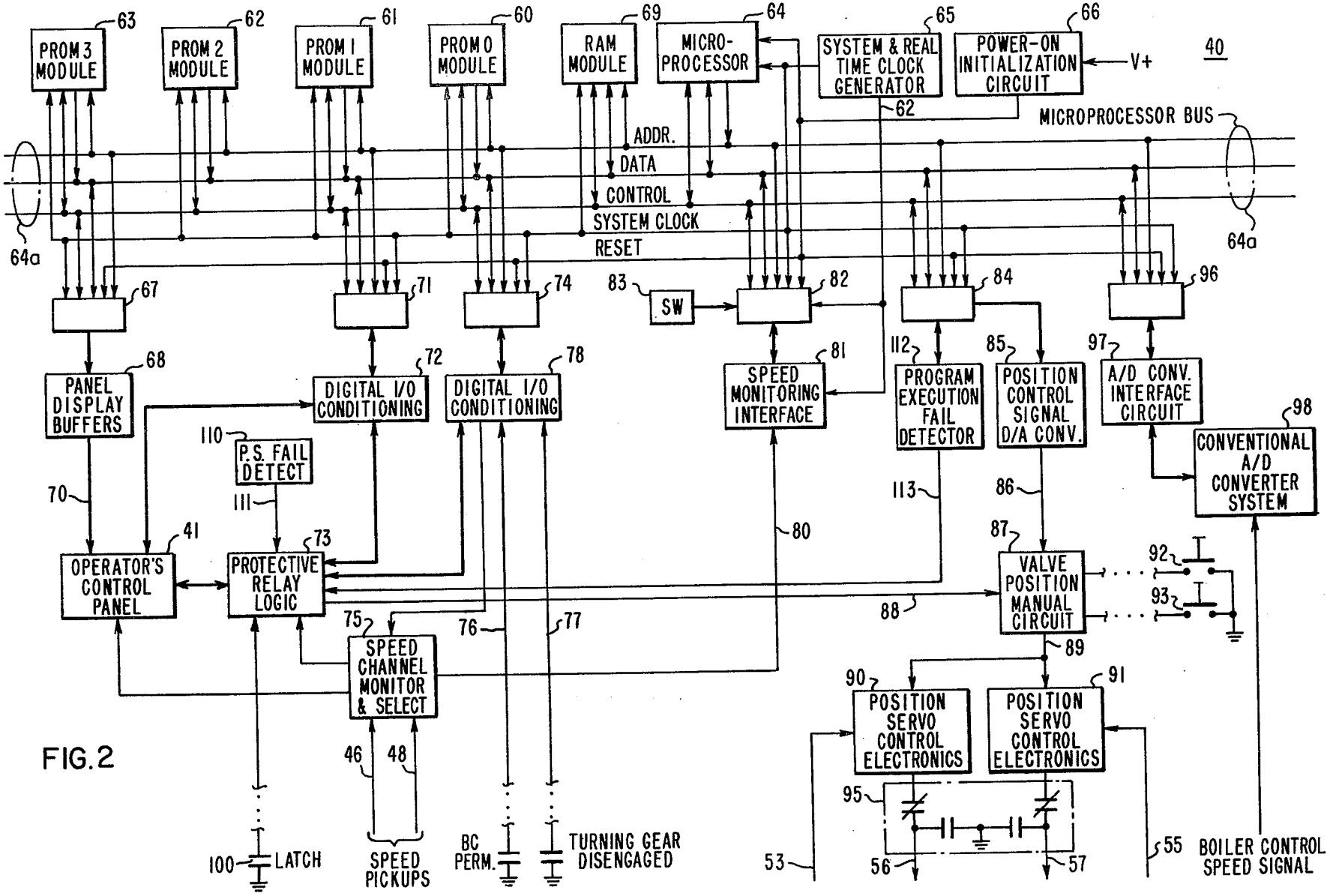
FIG. 2 is a block diagram schematic of an embodiment for a boiler feedpump turbine control system.

In FIG. 2, the boiler feedpump turbine control system 40 is depicted in a functional block diagram schematic architecture. Instructions and data words are permanently preprogrammed into a plurality of read-only memory modules 60, 61, 62, and 63. These instructions and data words are addressably ordered within these modules such that a microprocessor 64 may sequentially process the instructions and data words synchronously in accordance with a system clock generated by the clock generator 65. Random access memory (RAM) module 69 provides temporary storage for data words resulting from the processing operations of the microprocessor 64. A power-on initialization circuit 66 provides an initialization signal distributed to various registers throughout the boiler feedpump turbine control system 40 to initialize the various registers upon power turn-on to the control system 40. All instructions and data words conducted to and from the microprocessor 64 flow over a microprocessor bus **64*a*. Specific sets of instructions and data words are processed by the microprocessor 64 in accordance with periods of a real time clock signal generated by a clock generator circuit 65**.

An interface module 67 is coupled to the microprocessor bus **64*a* to permit the transfer of display data words therefrom synchronous to the signal generated from the system clock 65. The display data words from interface module 67 are buffered by display circuit 68. These display data words are provided to the operator's panel 41 over signal path 70**.

Another interface module 71 is coupled to the microprocessor bus **64*a* to synchronously conduct digital input/output data words therefrom. The digital input signals accepted by the interface module 71 may be derived from either the operator's control panel 41 or from a protective relay logic circuit 73. The output signals from interface module 71 may be coupled to the operator's control panel for possible use in driving display lamps and also may be used by the protective relay logic circuit 73 for purposes of energizing relays contained therein. These digital input and output signals are conditioned by a digital I/O conditioning circuit 72 prior to entering or exiting interface module 71. Still another interface module 74 is coupled to the microprocessor bus 64*a* and used for the purposes of conducting therefrom digital input and output data words. These digital input and output signals, for the purposes of this embodiment, are used for monitoring relay contacts from the protective relay logic 73 or for energizing relays contained in either the protective relay logic 73 or a speed channel monitor and select circuit 75. A contact is provided from the boiler feedwater control system 42 for the purposes of determining the validity of the boiler control turbine speed signal over signal line 76. This signal when true indicates a permissive for boiler feedwater system control of the rotational speed of the boiler feedpump turbine 1. Another contact is provided over signal line 77 from the boiler feedpump turbine 1 indicating that the turning gear motor is disengaged from driving the boiler feedpump turbine 1. All of the digital input and output signals controlled by interface module 74 are preconditioned using the digital I/O conditioning circuit 78**.

The speed signals generated over signal line 46 and 48 are monitored by the speed channel monitoring and select circuit 75 which functions to select one of either of these signals 46 or 48 and provide the selected signal over signal line 80 to a speed monitoring interface circuit 81. The speed monitoring interface circuit 81 functions to convert the speed pulses from signal line 80 into a speed measurement data word. The speed measurement data word is interfaced with an interface module 82. The interface module 82 is coupled to the microprocessor bus **64*a* for permitting the exchange of the speed measurement data word information to the microprocessor 64 at specific times dictated by the real time clock signal 62 generated by the clock generator circuit 65. A set of switches 83 is also connected to the interface module 82 for providing digital input information to the microprocessor 64. The states of the switches may correspond to an address of a register in a table of registers which contain control constants for use in the boiler feedpump control algorithms preprogrammed in the read-only modules 60, 61, 62, and 63**.

Another interface module 84 is coupled to the microprocessor bus **64*a* for accepting a position reference signal in digital format. A position control signal D/A converter circuit 85 is used to convert the digital position reference signal to an analog position reference signal which is conducted over signal line 86 to a valve position manual circuit 87. The valve position manual circuit 87 is responsive to signals generated by the protective relay logic over signal line 88** which determines if the positioning of the valves should be controlled by the microprocessor 64 or by a manual controller which is part of the valve position manual circuit 87. A position set point 89 is conducted to a position servo control electronic circuit 90 and another position servo control electronic circuit 91. Should the valve position manual circuit 87 be transferred to the manual mode of control the position reference signal 89 may be increased or decreased according to the state of pushbuttons 92 and 93, respectively, which are inputs to the valve positioning manual circuit 87.

The position servo control electronics circuit 90 positions the low pressure governor valves 25 using the hydraulic actuator control signal 56 and the measured position feedback signal 53. The position servo control electronic circuit 91 positions the high pressure governor valves 23 using the hydraulic actuator control signal 57 and the measured position feedback signal 55. The contact arrangement 95 coupled to the outputs of the servo control electronic circuits 90 and 91 functions to open circuit the hydraulic output control signals 56 and 57 from the hydraulic actuators and to short the signals to the hydraulic actuators to a ground potential. This in effect insures the complete closure of the high pressure governor valves 23 and low pressure governor valves 25 in case of a turbine trip condition.

A final interface module 96 which is coupled to the microprocessor bus 64*a* conducts information therefrom to a conventional A/D converter interface circuit 97 which controls the operation of a conventional A/D converter system 98 to digitize the boiler control speed signal coupled thereto. In addition, a latch contact 100 is provided to the protective relay logic 73 from the hydraulic system of the boiler feedpump turbine 1. A true indication of this latch contact 100 indicates that the hydraulic pressure is at a value to be functional. For a better understanding of the operation of the microprocessor based control system described above, a more detailed description is provided in the U.S. Pat. Application Ser. No. 771,141, filed Feb. 23, 1977, entitled "Programmable Turbine Speed Controller" by Zitelli et al which is incorporated by reference herein.

Figure 3:
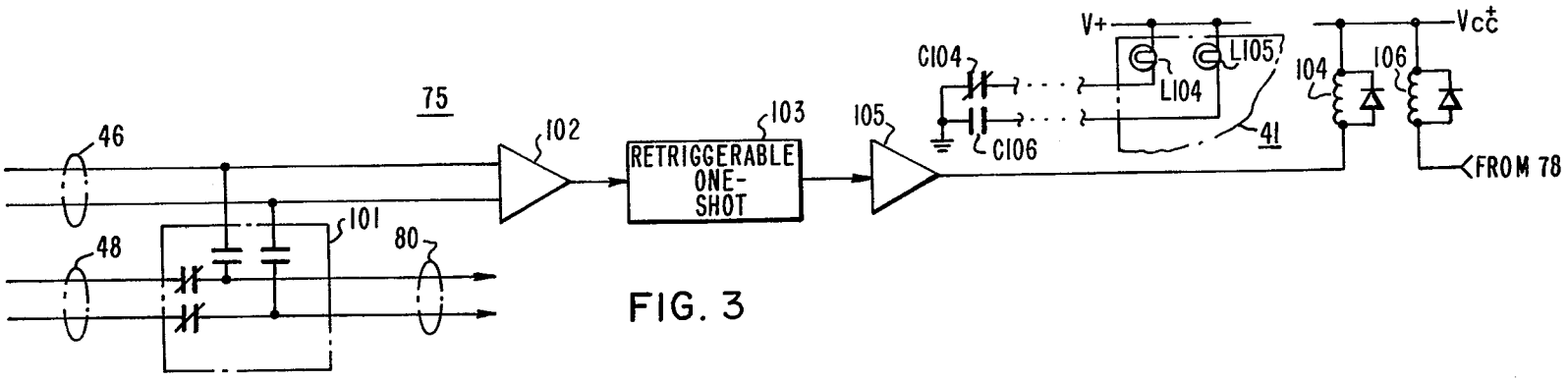
FIG. 3 is a schematic of a speed channel monitor and select circuit suitable for use in the embodiment of FIG. 2.

The speed channel monitor and select circuitry 75 is shown in more specific detail in FIG. 3. Referring to FIG. 3, the speed signals 46 and 48 are connected to a double-pull-double-throw relay contact arrangement 101. The relay contact arrangement selects one of the two speed signals and passes it along on signal line 80 to the speed monitoring interface 81 as shown in FIG. 2. The speed signal 46 is additionally coupled to a conventional zero crossing detector 102. The output of the zero crossing detector 102 is coupled to a retriggerable one shot 103, the output of which, when true, energizes relay 104 using the relay driver 105. The relay 104 is energized at times when the speed channel 46 is considered operational. A second relay 106 is energized by the microprocessor 64 using a digital output signal interfaced through interface module 71 and conditioned by the conditioning circuit 78 depicted in FIG. 2. The relay 106 is energized a times when the speed signal 48 is considered operational as determined by the microprocessor 64 in accordance with the processing of a set of instructions and data words as will be described in more detail hereinbelow. The contact arrangement 101 is part of the relay 106 and mechanically operates therewith. The normally closed contacts of 101 allow signal 48 to be conducted through signal path 80 to the speed monitoring interface 81. When speed channel 48 is detected as being non-operational or malfunctioning by the microprocessor 64 the relay 106 becomes energized and the normally closed contacts of contact arrangement 101 open and the normally open contacts of contact arrangement 101 close, thus providing the speed signal 46 to now be used through signal path 80 to the speed monitor 81 as a measure of the rotating speed of the boiler feedpump turbine 1. An additional normally closed contact C104 is provided as a part of relay 104 such that when relay 104 is deenergized a lamp L104 located within the operator's control panel is backlighted, indicating a malfunction in speed channel 46. Still another contact C106 normally open is provided as a part of relay 106 such that when relay 106 is energized indicating a malfunction in speed channel 48, contact C106 closes, backlighting a lamp L105 located in the operator's control panel 41 and indicating the malfunction of speed channel 48.

Under normal operation, relay 106 is deenergized, thus allowing speed channel 48 to be used by the microprocessor 64 through speed signal path 80 to speed monitoring interface 81 as the measured rotating speed of the boiler feedpump turbine 1. Additionally, as speed channel 46 while not being used is being monitored by the zero crossing detector 102, which transmits pulses to the retriggerable one shot 103. The output of the retriggerable one shot is maintained true as long as the pulses from the zero crossing detector fall within a predetermined time period. The true output of the retriggerable one shot 103 maintains the relay 104 energized using the relay driver 105. As long as the relay 104 is energized, the lamp L104 will not be lit and there will be no indication of a malfunction. Should speed channel 46 malfunction by no longer producing speed pulses as provided by the magnetic pickup 45, the zero crossing detector will no longer provide pulses to the retriggerable one shot. The retriggerable one shot will go false after a predetermined period, thus deenergizing relay 104. With relay 104 deenergized, the contact C104 will be closed such as indicated by its normally closed type contact and lamp L104 will be backlighted indicating a malfunctioning speed channel 46. Also, since speed channel 48 is normally used as the measured rotating speed of boiler feedpump turbine 1, the microprocessor 64 through processing the instructions and data words preprogrammed on the ROM modules 60–63 monitors the values of the speed channel to determine out-of-limit conditions for a possible malfunction as will be described in further detail herebelow. Should the microprocessor 64 in processing those instructions determine a malfunction, it may energize relay 106, thus causing a relay contact arrangement 101 to allow a switch-over to speed signal 46 as being that which is used by the microprocessor 64 as the speed measurement signal. In addition, relay 106 when energized causes contact C106 to close, thus backlighting lamp L105 which is an indication that speed signal 48 is malfunctioning.

Figure 4:
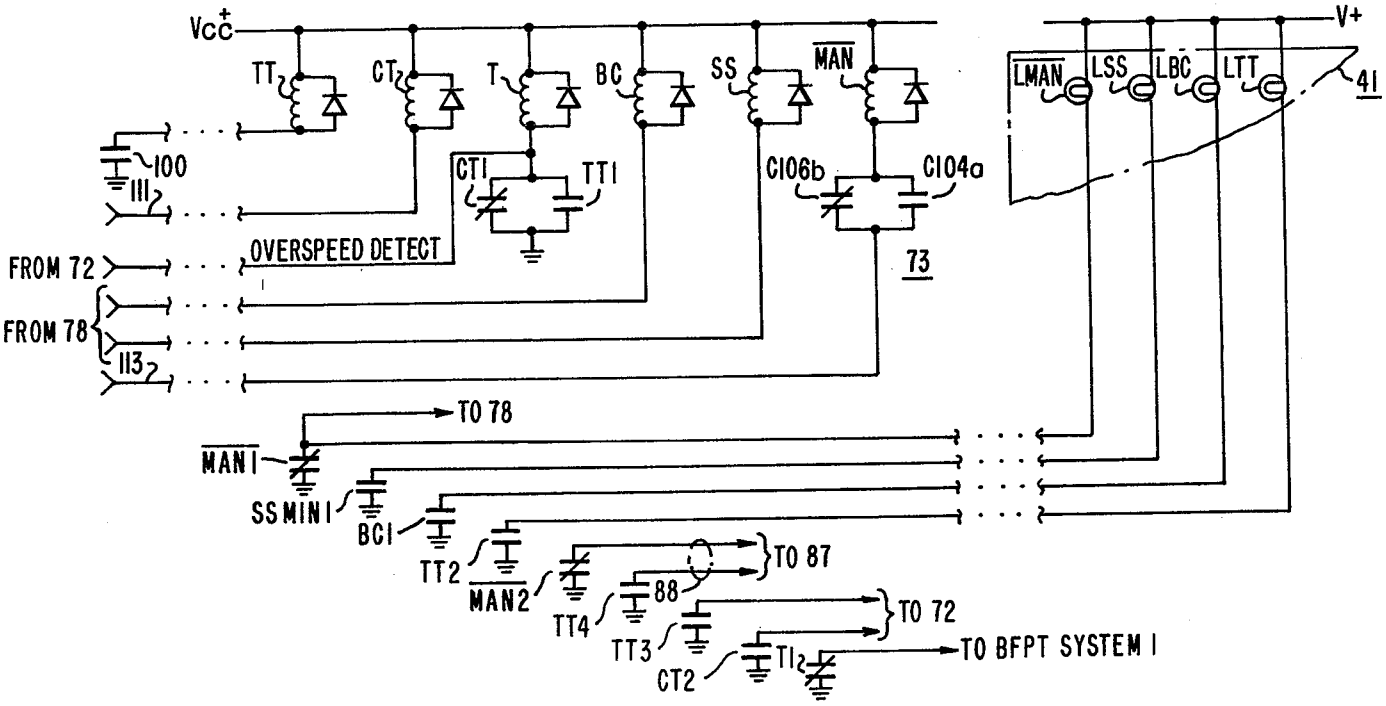
FIG. 4 is a schematic of a protective relay logic circuit suitable for use in the embodiment of FIG. 2.

A protective relay logic circuit arrangment found suitable for the purposes of this embodiment is shown in FIG. 4. A relay TT is coupled to the latch contact 100. The latch contact, as described above, is part of a pressure switch in the hydraulic system of the boiler feedpump turbine 1. This contact is operative to open as the pressure comes up to a suitable value for hydraulic operation. Thus, the relay TT is deenergized under normal conditions. A second relay CT is energized by a power supply fail detect circuit 110 as shown in FIG. 2. This power supply fail detect circuit 110 monitors the potentials of the power supplied to circuits 87, 90 and 91. When the potential of any one of these power supplies falls below a predetermined value, a signal 111 is generated to the protective relay logic circuit 73 to deenergize the relay CT, thus deenergization of relay CT is an indication that at least one of the power supply potentials is lost in the circuits 87, 90, 91 which renders these circuits inoperative in most cases. The third relay T is energized as a result of the states of the relay TT and relay CT. A normally closed contact CT1, which is mechanically coupled to and operative with relay CT, in parallel with a normally open contact TT1, which is mechanically coupled to and operative with relay TT, connect the relay T to ground potential. The relay T is also coupled to a digital output of the microprocessor 64 which functions to energize relay T at times when the feedpump turbine is determined to be in an overspeed state which will be more fully described herebelow. A fourth relay BC is connected to the digital output conditioning circuit 78 and is energized upon command of the microprocessor 64. In addition, a fifth relay SSMIN is also connected to the digital conditioning circuit 78 and accordingly is energized upon command of the microprocessor 64. A sixth relay $\overline{\text{MAN}}$ is connected in series to a parallel combination of a normally open contact C104*a* and a normally closed contact C106*a*, respectively operative in relation to relays 104 and 106, and the parallel combination of contacts are connected through signal line 113 to a program execution failure detect circuit 112, as shown in FIG. 2. The program execution failure detect circuit 112 is coupled to the interface module 84. The microprocessor 64 via interface module 84 maintains a true signal over signal line 113 at times when the microprocessor 64 is operating properly.

In operation, then, as the hydraulic pressure of the boiler feedpump turbine system 1 comes up to its operating value, the latch contact 100 opens, thereby deenergizing the relay TT connected to it. As power is turned on to the boiler feedpump turbine control system 40, the microprocessor 64 is initialized and through a program subroutine processes instructions to energize the relay MAN assuming that either one or the other of the speed channels 46 or 48 is operating properly as determined by relay contacts C104*a* and C104*b*, respectively. If the potential of the power supplied to circuits 87, 90 and 91 is above the predetermined value, the relay CT will be energized, thus the contact CT1 will be open circuit and the contact TT1 will also be open circuit, thus prohibiting relay T from becoming energized. During initial turn-on conditions or start-up conditions, the relay BC will remain deenergized. Should the speed set point be below a minimum value, the microprocessor 64 will detect this condition and energize relay SSMIN.

The relays BC and SSMIN are used primarily to light indication lamps on the operator's control panel 41. The relay contact BC1 mechanically attached to relay BC backlights lamp LBC when the relay BC is energized. Likewise, relay contact SSMIN1 mechanically attached to relay SSMIN backlights lamp LSS on the operator's control panel 41 at times when the relay SSMIN is energized. Also, if the microprocessor 64 is executing the instructions of the modules 60–63 in proper sequential order, the program execution failure detect circuit 112 will cause the signal line 113 to energize relay $\overline{\text{MAN}}$ if either one of the speed signals is operating properly; that is if either relay 104 is energized or if relay 106 is deenerized. The relay $\overline{\text{MAN}}$ may have mechanically attached thereto a number of normally closed and normally opened contacts. One such normally closed contact $\overline{\text{MAN1}}$ is connected to lamp $\overline{\text{LMAN}}$ on the operator's control panel 41 and is backlighted as a result of deenergizing relay $\overline{\text{MAN}}$. This same contact is monitored by the microprocessor 64 via interface module 74 and digital input conditioning circuit 78. In addition, another normally closed contact $\overline{\text{MAN2}}$ is provided over signal line 88 to the manual circuit 87 for purposes of activating manual control. A normally open contact TT2 which is mechanically attached to the relay TT is coupled to a lamp LTT on the operator's control panel 41. When the relay TT is energized, the relay contact TT2 closes and backlights the lamp LTT on the operator's control panel 41 providing an indication therefor. Another normally open contact of the relay TT labeled TT3 is monitored by the microprocessor 64 via interface module 71 and digital input conditioning circuit 72. A fourth normally open contact which is mechanically attached to the relay TT and labeled TT4 is provided over signal lines 88 to the manual circuit 87. And finally, a normally open contact CT2 which is mechanically attached to relay CT is monitored by the microprocessor 64 via interface module 71 and digital input conditioning circuit 72.

Should the pressure of the hydraulic fluid which is used to operate the boiler feedpump turbine steam admission valves drop below a predetermined value, the pressure switch, latch contact 100 will close, thus energizing the relay labeled TT. This in turn results in the relay contact TT1 closing thereby energizing relay T. The relay arrangment 95 as shown in FIG. 2 is also mechanically linked to the relay TT and at times when relay TT is energized the signals 56 and 57 are no longer controlled by the position servo control electronic circuits 90 and 91, but are at that time shorted to ground potential. In addition, the relay contact labeled TT4 which is provided to the manual circuit 87 over signal lines 88 affects the position reference signal 89 to a zero potential as will be described in further detail hereinbelow. The microprocessor 64 will also be made aware of the hydraulic fluid pressure drop by monitoring relay contact TT3 and the operator will be provided with an indication of the relay energization by illuminating the lamp LTT when relay contact TT2 is shorted to ground.

Another malfunction which may occur is the loss of power supply to the circuits 87, 90 or 91 which will render the boiler feedpump turbine uncontrollable in either the microprocessor control or manual control states. In this case, the power supply fail will be detected by circuit 110 and signal 111 will go false. In response to signal 111 going false, relay CT will be deenergized. When CT is deenergized, relay contact CT1 provides a circuit path to ground potential for relay T thus energizing relay T. A relay contact T1 mechanically linked to relay T provides a trip signal to the hydraulic system of the boiler feedpump turbine 1 which immediately initiates closure of the steam admission valves. The pressure switch of the hydraulic fluid pressure will sequentially thereafter be closed, energizing relay TT and the actions which were previously described in connection with the energization of relay TT will be performed. Another example of a possible malfunction is in the microprocessor instruction execution according to an incorrect addressable order of instuctions preprogrammed in the ROM modules 60–63. Should the microprocessor 64 execute instructions out of order or cease to execute instructions, the program execution failure detect circuit 112 will indicate this condition over signal line 113 and cause the relay $\overline{MAN}$ to deenergize. In another case, should both speed signals 46 and 48 be determined malfunctioned by the deenergization of relay 104 and the energization of relay 106 the state of contacts C106*a* and C104*a* will break the circuit between signal line 113 and relay $\overline{MAN}$, thereby deenergizing the relay $\overline{MAN}$. The relay contact $\overline{MAN1}$ will close to ground, thus illuminating the lamp $\overline{LMAN}$. In addition, the relay contact $\overline{MAN2}$ will go to ground, activating the manual control over signal line 88 to manual circuit 87. The governor steam admission valves are controlled in this state by the pushbutton switches 92 and 93, as shown in FIG. 2.

Figure 5:
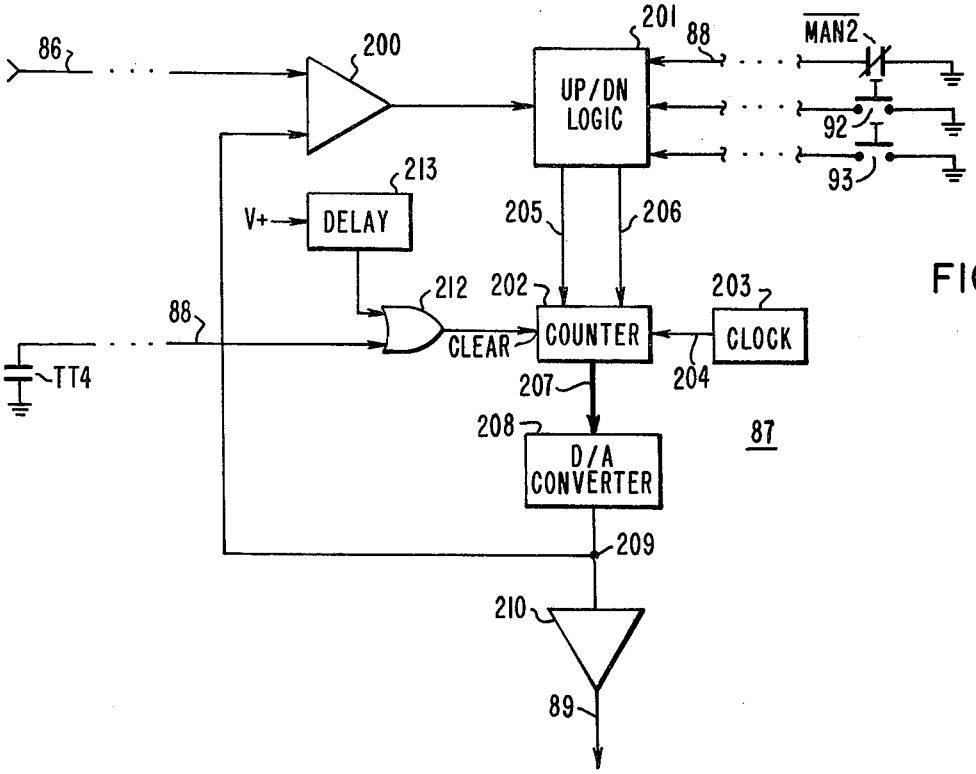
FIG. 5 is a block diagram schematic depicting the operation of a valve position manual circuit suitable for use in the embodiment of FIG. 2.

The valve position manual circuit 87 is shown in more specific detail in the functional block schematic diagram of FIG. 5. Referring now to FIG. 5, the position reference set point 86 is connected to one input of a conventional comparator 200. The output of the comparator is used as a logical input to an up-down logic circuit 201. Other inputs of the up-down logic circuit 201 are the normally closed contact $\overline{MAN2}$, the pushbutton 92 and the pushbutton 93. In accordance with the states of the inputs, a counter 202 is counted up or down at the rate of clock pulses over signal line 204 provided by a clock 203. The up-down logic circuit provides up 205 and down 206 signals to the counter for control thereof. The digital date word output 207 of counter 202 is provided as the digital input to a conventional D/A converter 208. The output of the D/A converter 208, signal 209, is amplified by a conventional amplifier 210 to generate the position set point signal 89 which is conducted to the position servo control electronic circuits 90 and 91. The signal 209 is also fed back to the second input of the comparator 200. The relay contact labeled TT4 is connected to one input of a typical OR gate 212. The second input to the OR gate 212 is connected to the power supply V+ through a standard delay circuit 213. The output of the OR gate 212 is connected to the clear input of the counter 202.

In operation, then, as power is turned on to the boiler feedpump turbine control system 40, the delay circuit 213 maintains a zero at the input of the OR gate 212 for a period of time defined by the delay 213, thus initially forcing the counter 202 to all zeros. Therefore, the counter 202 is initialized upon power turn-on to the zero state. Under normal operating conditions, that is, hydraulic fluid pressure operating at operating levels and not in the manual state, the manual circuit 87 tracks the position reference signal 86 as follows. The comparator 200 detects when the position reference signal 86 is greater or less than the feedback signal 209 which is the output of the D/A converter 208. The up-down logic circuit 201 is responsive to the output of the comparator 200 at times when not in manual. The output state of the comparator 200, that is, a one or zero, controls the logical states of the signals 205 and 206 to control the counter in either the up or down counting mode. Should the position reference signal 86 be greater than the signal 209, the comparator as an example could go to the one state forcing the up signal 205 in the one state which in turn allows the counter 202 to count up according to the rate of the clock signal 204. The digital data output 207 of the counter 202 will cause the D/A converter output signal 209 to increase in value to equate to the reference signal 86. As the signal 209 increases in value beyond the position reference signal 86, the comparator will change state, causing the signal 205 to become false and the signal 206 to become true, thus forcing the counter to count down. This is considered a tracking condition and in this state the counter will be toggling ± 1 bit about the position reference signal value, normally referred to as unit cycle oscillation tracking. The position set point signal 89 will be within one bit at all times of the position reference signal 86 according to the operation of the embodiment described above.

Should the manual circuit 87 be activated to the manual state, the signal line 88 connected to the relay contact $\overline{MAN2}$ will be shorted to ground potential. The updown logic circuit 201 will thereafter be unresponsive to the output of the comparator and will be only responsive to the up and down pushbuttons 92 and 93, respectively. The position set point signal 89 will remain at its value prior to manual activation. The signals 205 and 206 will be operative in concurrence with the depression of the pushbuttons 92 and 93, respectively. The output position set point signal 89 will respond accordingly. Thus control is achieved by manually depressing the pushbuttons 92 and 93.

Figure 6:
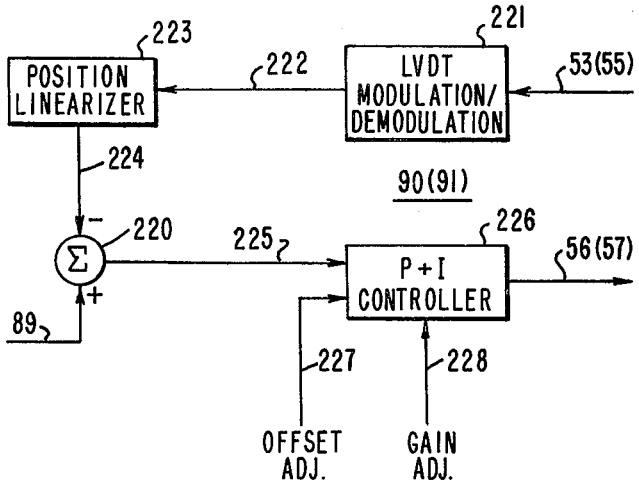
FIG. 6 is a block diagram schematic exemplary of a position servo controller.

A functional block diagram schematic of the position servo electronics 90 and 91 is shown in FIG. 6. The position set point 89 is one of the inputs to a summing junction 220. The other of the inputs is derived from the position feedback signal 53 (55) conducted from the position detector 52 (54) as shown in FIG. 1. This signal is conditioned by a conventional LVDT modulation/demodulation circuit 221. Because the flow versus lift characteristics of a typical steam admission valve are non-linear, a demodulated position signal 222 of the output of the circuit 221 is generally position linearized by a circuit 223, thus providing a signal 224 more directly proportional to the flow of steam conducted through the steam admission valves. The output of the position linearizer circuit signal 224 is provided as the other input to the summing junction 220 of opposite sign to the position set point signal 89. The error produced by the signals 89 and 224 is denoted as signal 225. This error signal is conventionally operated on by a proportional plus integral controller 226. The output of the proportional plus integral controller 226 is the hydraulic actuator control signal 56 (57). The proportional plus integral controller 226 normally has included therein an offset adjustment 227 and a gain adjustment 228. It is understood that these circuits were found suitable for the purposes of this embodiment, however, one or more portions of these circuits may be deleted therefrom without departing from the operation of the invention.

Figure 7:
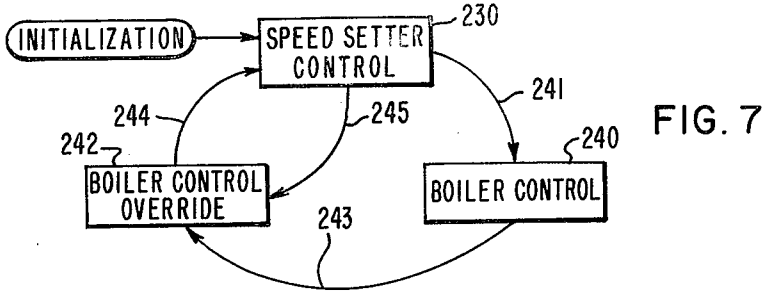
FIG. 7 is a functional diagram exhibiting three modes of operation of the boiler feedpump turbine control system and the transfers which are permitted to occur according to one embodiment of the invention.

The boiler feedpump turbine control system 40 is characterized to operate in one of three automatic control modes by the preprogramming of the ROM modules 60–63 as simply illustrated in FIG. 7, for example. The first of the three automatic control modes is denoted as the speed setter control mode as shown in block 230. In this mode an operator through use of the operator's control panel 41 can adjust the rotational speed of the boiler feedpump turbine 1 from zero rotational speed to the speed value of a boiler control turbine speed signal which is provided to the boiler feedpump turbine control system 40 by the boiler feedwater control system 42. The second of the two automatic control modes is denoted as the boiler control mode and shown as block 240. The transfer between the speed setter control mode and boiler control mode occurs automatically when the operator speed set point is initially equated to the boiler control turbine speed signal. This transfer is shown in FIG. 7 by the path 241. The third automatic control mode of the boiler feedpump control system 40 is denoted as boiler control override mode as shown in block 242. The transfer from the boiler control mode 240 to the boiler control override mode 242 as shown by path 243 in FIG. 7 may occur as a result of either of three conditions described as follows:

(1) any time an "override" push button is depressed on the operator's control panel 41;

(2) the value of the boiler control turbine speed signal is found to be outside its preset limits; and (3) the boiler control permissive contact over signal line 76 as shown in FIG. 2 is false.

Indications of operation in either of the three control modes is provided to the operator through backlighting monitor lamps on the operator's control panel 41. In the case of the boiler control override mode, the pushbutton which activates the boiler control override mode is backlighted when the boiler feedpump turbine control system 40 is operating in the boiler control override mode. If transfer is made along path 243 to the boiler control override mode 242 by conditions 2 or 3, the override pushbutton will also be backlighted. It is also possible, as will be described in connection with the flowchart programming of the ROM modules 60–63 of the boiler feedpump turbine control system 40 found below, to transfer between the boiler control override mode 242 and the speed setter control mode 230 over paths 244 and 245 as shown in FIG. 7. Transfer along the path 244 may occur if the override pushbutton is depressed when backlighted provided that the operator set point is less than the remotely provided boiler control turbine speed signal. Otherwise, this transfer will be prevented. The transfer over path 245 may occur any time that the override pushbutton is depressed when not backlighted, independent of any other conditions.

Under normal conditions, as power is supplied to the boiler feedpump turbine control system 40 and the control system 40 is initialized as a result thereof, the speed setter control mode 230 will automatically assume control. The operator may under this speed setter control mode adjust a speed demand signal utilizing pushbuttons located on the operator's control panel 41. This speed demand signal controls the internal speed set point of the boiler feedpump turbine control system 40 while in the speed setter control mode 230. The operator normally controls this speed set point up to the speed value of the boiler control turbine speed signal, at which time, the transfer as shown as signal path 241 in FIG. 7 is performed. In accordance with this embodiment, the operator may no longer control the rotational speed of the boiler feedpump turbine 1 while in the boiler control mode 240 unless he overrides the boiler control mode 240 by generating an override command such as depressing an override pushbutton which is located on the operator's control panel 41, for example. While in the boiler control mode 240, the speed set point is being controlled by the boiler control turbine speed signal provided by the boiler feedwater control system 42 and further the speed demand signal normally controlled by the operator, when in the speed setter control mode, is tracking the speed set point value. Therefore, when a transfer is made from the boiler control mode 240 along path 243 to the boiler control override mode, the speed demand signal will be equated to the speed set point and boiler control turbine speed signal such that no disturbance in the rotational speed of the boiler feedpump turbine 1 will be exhibited and therefore no disturbance to the feedwater flow to the boiler will result.

While in the boiler control override mode 242, the operator may control the speed set point with the speed demand signal over a range from 0 to 100% of rated rotational turbine speed. Normally, this override option is taken because of some anomaly that has occurred in the boiler feedpump turbine system or perhaps in the boiler feedwater overall control system. It is understood that when in the speed setter control 230 the operator may exclude the transfer to the boiler control mode 240 by merely depressing the override pushbutton, the transfer of course will occur along path 245 thereafter providing the power plant operator with control of the rotational speed of the turbine beyond the boiler control turbine speed set point value while in the boiler control override mode 242. To return the speed control from the boiler control override mode 242 to the speed setter mode 230, the operator may adjust the speed set point below the boiler control turbine speed signal and merely depress the override pushbutton. Due to the system of speed set point controls and speed set point tracking which has been described hereinabove, all such transfers are permitted to occur without substantial change in rotational speed of the turbine, thus effecting essentially no feedwater flow disturbance to the boiler.

Figure 8:
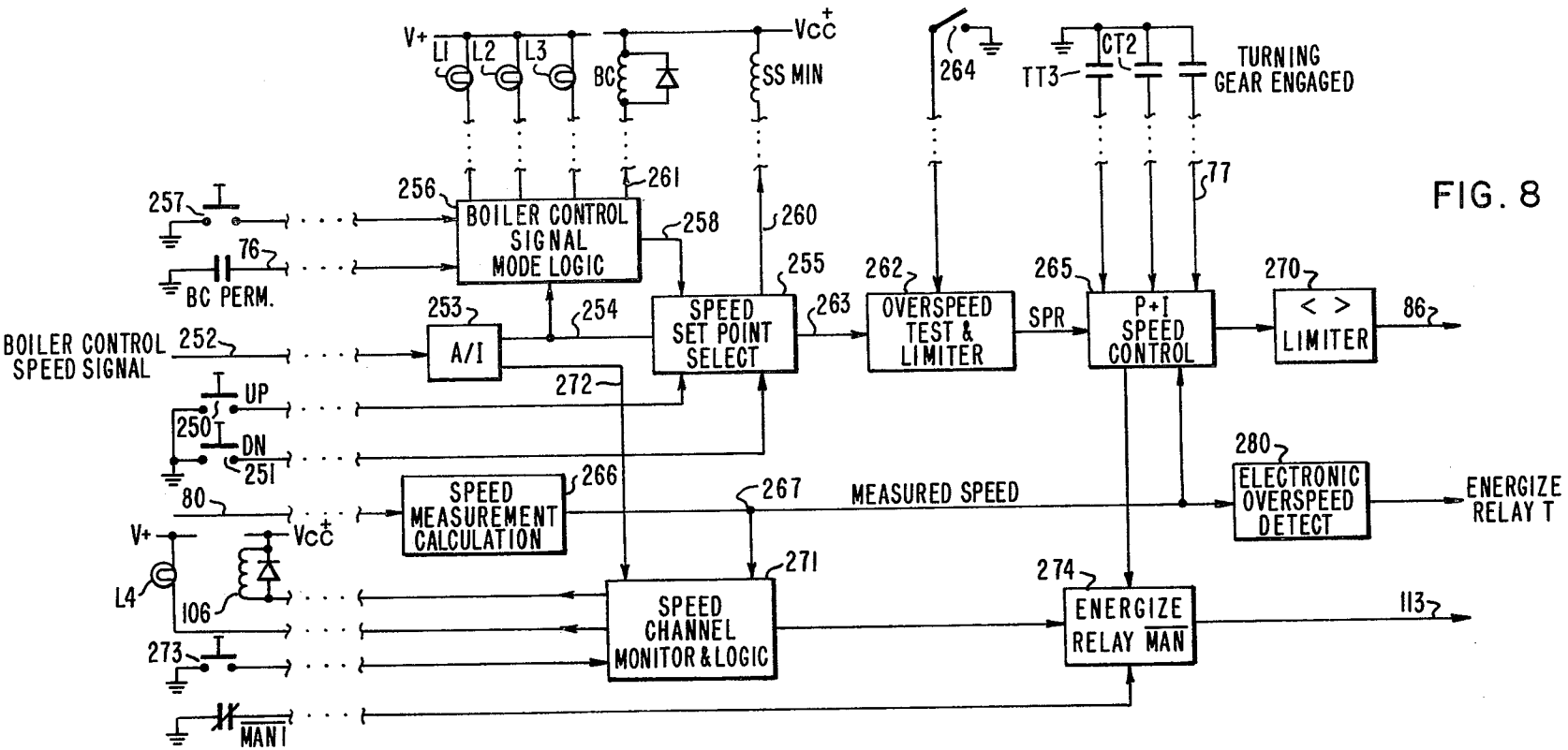
FIG. 8 is a functional block diagram depicting the functions employed by the boiler feedpump turbine control system of FIG. 2.

A more detailed functional block diagram of that which may be characterized by the preprogramming of the ROM modules 60–63 and that which may become operational by the execution of the instructions and data words within the ROM modules 60–63 by the microprocessor 64 is shown in FIG. 8. The speed set point which is generated within the microprocessor based speed controller of the boiler feedpump turbine control system 40 may be controlled by either speed setter pushbuttons 250 and 251 which are located on the operator's control panel 41 to provide an up adjustment or down adjustment respectively of the speed demand signal according to a predetermined rate or a boiler control speed signal 252 which is provided to the boiler feedpump turbine control system 40 by the boiler feedwater control system 42. The boiler control speed signal 252 is digitized using an analog input algorithm 253 to produce a digitized boiler speed control signal 254 which is provided to a speed set point select circuit 255 along with the inputs or the speed setter pushbuttons 250 and 251. The digitized boiler control speed signal 254 is also provided to a boiler control signal mode logic function 256. Also provided as inputs to the boiler control signal mode logic 256 are a boiler control override pushbutton 257 and the boiler control permissive contact 76. One of the lamps L1, L2, and L3 located on the operator's control panel 41 is backlighted by the boiler control logic mode function 256 in accordance with the selection of either the speed setter control mode, the boiler control mode, or the boiler control override mode, respectively. The boiler control signal mode logic function 256 operates in cooperation with the speed set point select function 255 using control line 258 to provide control of the speed set point by either the speed setter pushbuttons 250 and 251 or the boiler control speed signal 252 in accordance with the description as provided in connection with FIG. 7. Should the speed set point be adjusted to a value below a predetermined minimum value, the relay SS MIN will be energized using signal line 260. In addition, when the boiler control mode is selected for operation, the relay BC will be energized over signal line 261 by the boiler control signal mode logic function 256.

The speed set point is provided to an overspeed test and limiter function 262 over signal line 263. The overspeed test portion of function 262 is made operative by the state of an overspeed test enable signal such as the closure of an overspeed test switch 264 which may be located on the operator's control panel 41, for example. When the overspeed test portion of function 262 is not activated by the switch 264, the speed set point is limited to 100% of rated turbine rotating speed by the limiter portion of function 262 before being provided to a proportional plus integral speed control function 265. The speed set point is the reference input to the proportional plus integral speed control function 265. The selected speed pulse signal 80 is operated on by a speed measurement calculation algorithm 266 which conditions the speed pulse signal into a recognizable speed measurement data word 267. This speed measurement data word is provided as the feedback signal to the proportional plus integral speed control function 265. Permissives to the operation of the proportional plus integral speed controller 265 are derived from the relay contacts TT3, CT2, and turning gear engaged 77. Should any one of these contacts provide a positive signal, that is true signal, the output of the proportional plus integral speed control function 265 will be rendered at zero potential. The output of the function 265 is limited in value between a predetermined upper and lower limits by the limiter function 270. The output of the limiter circuit 270 may be functionally considered as the speed reference signal 86.

The conditioned speed measurement data word 267 and a digital signal 272 which indicates that the analog input system function is operating properly are inputs to the speed channel monitor and logic function 271. Another input to the function 271 is a manual pushbutton 273 which is located on the operator's control panel 41. The speed channel monitoring function of 271 compares the measured data word 267 to predetermined limits. Should the speed measurement data work 267 be outside those predetermined limits, the relay 106 will be energized thereby. The function 271 also contains additional logic to permit the activation of the manual control mode through depression of the manual pushbutton 273. During the sequential execution of the instructions by the microprocessor 64, a request is made by both the proportional plus integral speed control function 265 and the logic function 271 to energize the relay $\overline{\text{MAN}}$ over signal line 113 depicted by the functional block 274 in FIG. 8. Should either one of these functions 265 or 271 fail to request energization of the relay $\overline{\text{MAN}}$, the signal over 113 will be made false by the function 274, thereby deenergizing the relay $\overline{\text{MAN}}$. The function 274 additionally monitors the energization of relay $\overline{\text{MAN}}$ through use of the contact $\overline{\text{MAN}}$1. If the relay $\overline{\text{MAN}}$ is not energized, certain portions of the program execution will be eliminated until such time as the $\overline{\text{MAN}}$1 normally closed contacts indicates energization of the relay $\overline{\text{MAN}}$. This will be described in better detail in connection with the flowcharts of FIGS. 9A through 9E.

Referring back to the overspeed test function of block 262, when the overspeed test switch 264 is initially closed, the overspeed test function of block 262 is activated and the boiler feedpump turbine control system 40 is transferred to the boiler control override mode shown as block 242 in FIG. 7. When in overspeed test, the speed set point is permitted to exceed a value of 100% rated turbine rotational speed. A new limiting value under overspeed test is typically selected at 120% rated turbine rotational speed. Therefore, an operator can control the speed beyond 100% rated between 100% and 120%, for example, to test any overspeed detection circuits or mechanical overspeed trip systems. In addition, if the overspeed test switch is open while the speed set point is greater than 100% rated turbine rotational speed, the overspeed test function of block 262 will automatically decrease the speed set point at a predetermined rate to 100% rated turbine rotational speed, or a value substantially close thereto. Thus, when the boiler feedpump turbine control system is not in overspeed test, the speed set point is not permitted to remain greater than 100% rated turbine rotational speed.

An electronic overspeed detect function 280 is also characterized by the preprogrammed ROM modules 60–63 and executed by the microprocessor 64 as depicted in FIG. 8. The speed measurement data word 267 is provided to the electronic overspeed detect function 280 and if this speed data word is greater than a predetermined value, typically 110% rated rotational speed, the relay T will be energized by a digital signal conducted through interface module 71 and digital output conditioning circuit 72 as shown in FIG. 2.

The following table is provided to define the Mneumonics used in connection with the description of the flowcharts of FIGS. 9A, 9B, 9C and 9D.

MNEUMONIC DEFINITIONS

Figure 9A:
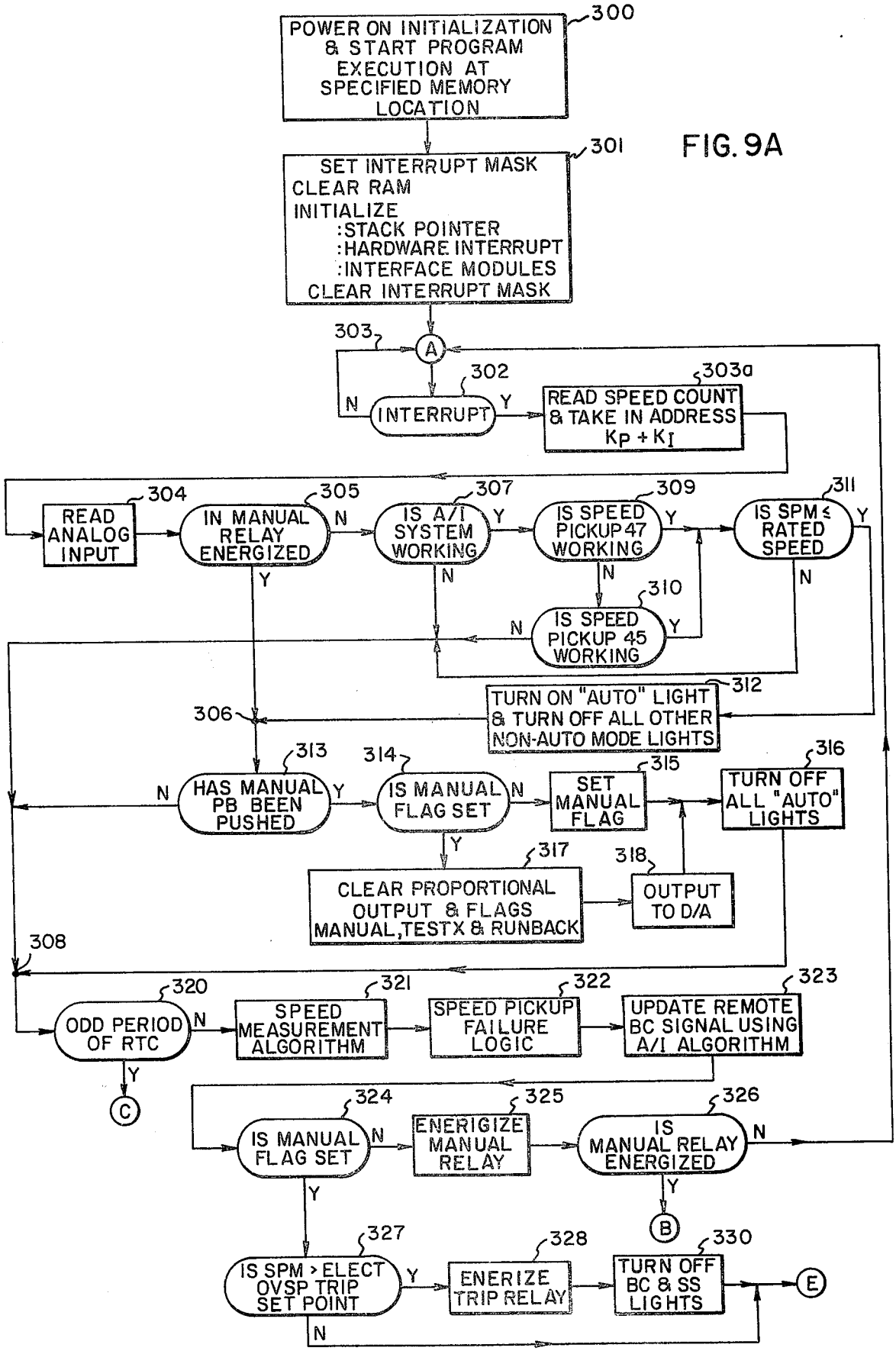
FIGS. 9A through 9E are a set of suitable flowcharts from which the read-only memory modules of the embodiment of FIG. 2 may be programmed.

BC = Boiler Control
BCSS = Boiler Control Speed Signal
SS = Speed Setter Control
SP = Set Point
SPM = Measured Speed
PB = Pushbutton
RS = Rated Speed
SPR = Speed Reference
= Time
$P_N$ = Position Reference
OTKS = Overspeed Test Key Switch
OVSP = Overspeed
$K_I$ = Reset Time
$K_P$ = Proportional Gain The instructions and data words which are preprogrammed in the ROM modules 60–63 may be executed by the microprocessor 64 synchronously under the control of the system clock generated by clock generator 65 in accordance with the functional description in connection with FIGS. 7 and 8. The following FIGS. 9A, 9B, 9C, 9D, and 9E are flowcharts from which one skilled in the pertinent art may generate program listings corresponding to the specific microprocessor system being used for implementation of the functions of FIGS. 7 and 8. Referring now to FIG. 9A, program execution begins upon power turn-on. The power-on initialization circuit 66 depicted in FIG. 2 generates an initialization signal to the microprocessor 64 and to the interface modules 67, 71, 74, 82, 84 and 96. The microprocessor 64 in response to the initialization signal begins executing instructions at a specified location in one of the ROM modules 60–63 (refer to block 300). In block 301, an initialization routine is executed by the microprocessor 64 wherein an interrupt mask is first set, the registers of the random access memory module 69 as shown in FIG. 2 are cleared, an address is provided for the stack pointer vector, an address is provided for the hardware interrupt vector, the control registers and data direction registers normally associated with the interface modules are initialized and thereafter the interrupt mask is cleared.

As has been described in connection with FIG. 2, the real time clock signal generated from the clock generator 65 is used as a hardware interrupt signal wherein the microprocessor 64 begins execution of all of the characterizing functions subsequent to point A of the flowchart shown in FIG. 9A. The following block 302 labeled interrupt and signal path 303 in combination define a wait for interrupt loop. After executing the instructions associated with an instant hardware interrupt as will be described in more detail hereinbelow, the program execution will be returned to point A, as shown in flowchart in FIG. 9A. The microprocessor 64 will then cycle in this wait for interrupt loop until it receives the next hardware interrupt generator by the real time clock. Upon receiving a hardware interrupt from the real time clock signal, the microprocessor 64 begins execution of the instructions which initiate at functional block 303*a*. The functions of block 303*a* comprise reading the speed count generated by the speed monitoring interface 81 and also the address generated by the switches 83 through the interface module 82 as shown in FIG. 2. The address associated with the state of the switches 83 provide the proportional gain and reset time constants for the proportional plus integral speed control function 265 as shown in FIG. 8.

Next, in block 304 the value of the boiler control speed signal 252 is read into a memory location of the random access memory module 69 using the analog input algorithm 253 as shown in connection with FIG. 8. Then, in block 305 the relay contact $\overline{\text{MAN1}}$ is monitored to determine whether the relay $\overline{\text{MAN}}$ is energized. If the relay $\overline{\text{MAN}}$ is energized, program execution jumps to point 306 in the flowchart. Otherwise, the analog input system is checked for proper operation by monitoring digital signal 272 using functional block 307. If the analog input system is not functional, program execution jumps to point 308; otherwise, functional blocks 309 and 310 determine if the speed pickups 45 and 47 are working properly. If at least one of the speed pickups are functional, program execution continues at block 311; else, program execution is reverted to point 308. In block 311 the calculated speed measurement value is compared with the 100% rated speed value and if greater, program execution continues at point 308; otherwise, the auto light is turned on and all the lamps associated with the manual mode are turned off by block 312. Decisional block 313 determines if the manual pushbutton 273 has been depressed. Instructions starting at point 308 are executed next if the manual pushbutton has not been depressed. If the pushbutton has been depressed, it must next be determined if the manual flag has been set by block 314. If the manual flag has not been set, it is now set by the block 315 and all of the lamps associated with the auto mode are turned off by block 316 and program execution continues at point 308. If the manual flag has already been set, block 317 acts to clear the output of the proportional plus integral speed control function shown as 265 in FIG. 8 and also to clear certain flags which will be used in the subsequent blocks of these flowcharts described below. Next, the cleared output of the proportional plus integral speed control function is output through the position control signal D/A converter 85 using block 318. Then, all of the auto mode lights are turned off by block 316 and program execution continues at point 308.

Decisional block 320 splits the execution of the characteristic instructions of the ROM modules 60–63 into two sets. One set is executed during the odd periods of the real time clock (RTC), the other set is executed during the even periods of the real time clock. If it is determined that a hardware interrupt is initiated during an odd period, program execution continues at point C as shown in FIG. 9D; otherwise, a new speed measurement is calculated by block 321 using the instant speed count provided by block 303*a* above. Block 322 compares the new speed measurement value with predetermined upper and lower limits to establish if the speed pickup being used is operating properly and sets flags accordingly. These flags are used by the functions 309 and 310 described above. The most recent value of the boiler control speed signal is read in by the microprocessor 64 using block 323 and a corresponding memory location in RAM module 69 is updated accordingly. Decisional block 324 determines if the manual flag has been set, and if it hasn't, block 325 attempts to energize the relay $\overline{\text{MAN}}$. Decisional block 326 then monitors the $\overline{\text{MAN1}}$ contact to establish if the relay $\overline{\text{MAN}}$ has been energized. If the relay $\overline{\text{MAN}}$ has not been energized, program execution returns to the wait for interrupt loop at point A. If the relay $\overline{\text{MAN}}$ has been energized, program execution begins next at point B shown in FIG. 9D.

Referring back to block 324, if the manual flag has been set, the speed measurement value last calculated is compared with an electrical overspeed trip set point, typically 110% of turbine rated rotational speed, using block 327. If the speed measurement value is greater than the trip set point, the relay T is energized by block 328 and the boiler control and speed lamps are turned off by block 330. If the measured speed value is below the trip set point, the relay T is not energized and in either case program execution continues at point E as shown in FIG. 9D.

Figure 9B:
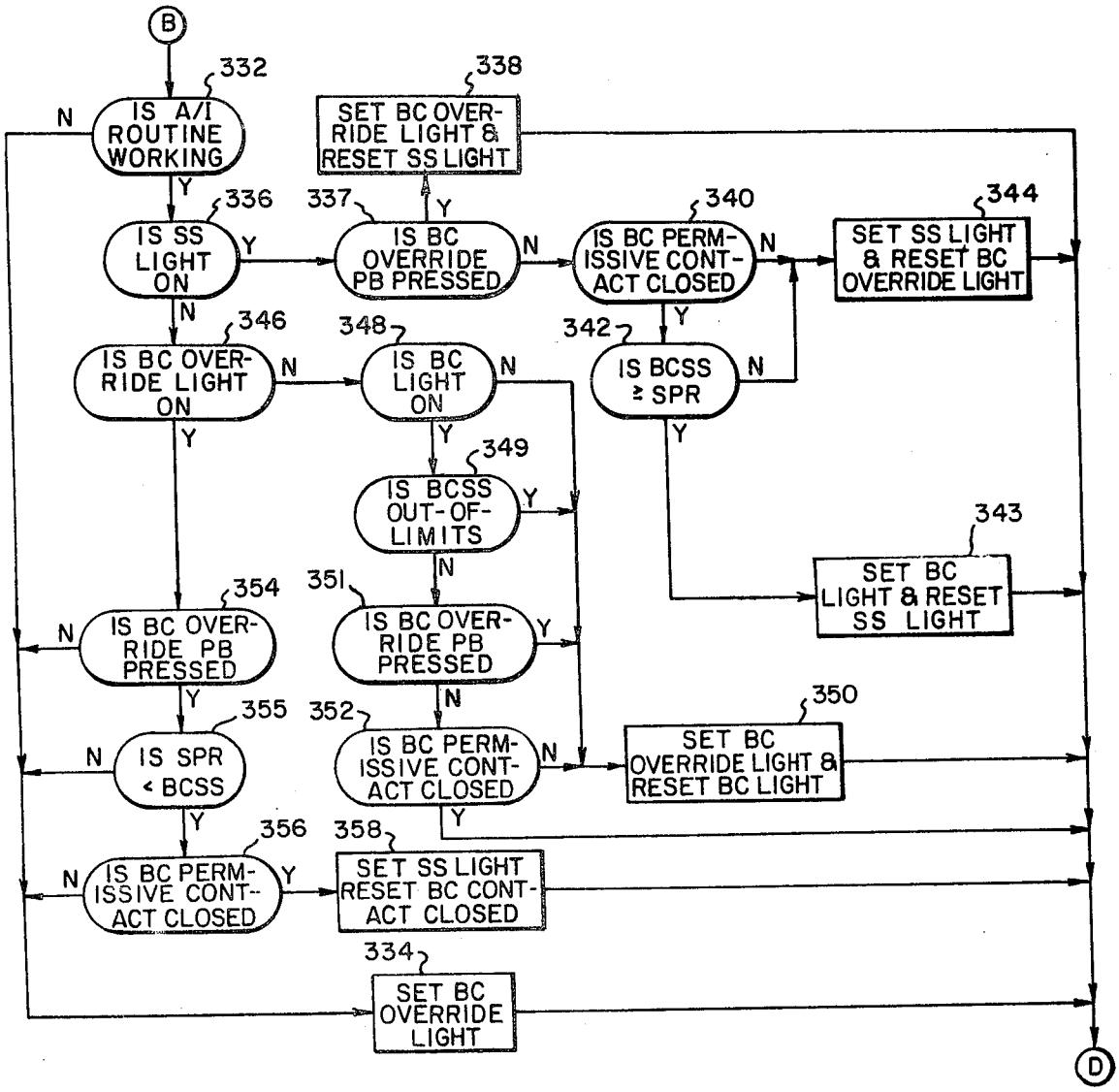

Referring now to FIG. 9B, decisional block 332 again establishes if the analog input system is working properly and if not, program execution is reverted to block 334 where the boiler control override light is set constituting a transfer of operation to boiler control override mode. Next, decisional block 336 determines if the speed setter lamp is lit constituting operation in the speed setter mode. If the speed setter lamp is backlighted, it may next be determined if the boiler control override pushbutton 257 has been depressed, which is performed by block 337. If it has been depressed, boiler feedpump turbine control system operation is transferred to the boiler control override mode by setting the boiler control override light and resetting the speed setter lamp using block 338. Program execution is then continued at point D shown in FIG. 9C. If the boiler control override pushbutton has not been depressed, it may next be determined if the boiler control permissive contact 76 has been closed, which is an indication of a valid boiler speed control signal. The boiler control speed signal is compared with the speed set point and if it is equal or greater than the speed set point reference signal as determined by block 342, the transfer to boiler control mode depicted by path 241 in FIG. 7 is initiated by block 343 wherein the boiler control light is set and the speed setter light is turned off. Thereafter, program execution is continued at point D. If the boiler control permissive contact 76 is not closed as determined by block 340, the boiler feedpump turbine control system 40 will remain in the speed setter mode, the speed setter light will be set and the boiler control override light will be reset by block 344, and program execution will continue at point D.

Referring back to functional block 336, if the speed setter light is not lit, block 346 next determines if the boiler control override light is lit, which is an indication that the boiler feedpump turbine control system 40 is operating in the boiler control override mode. If the boiler control override light is not lit and the boiler control light is not lit as determined by block 348, then the system will be considered in the boiler control override mode, setting the boiler control override light and resetting the boiler control light using functional block 350. Then programming execution will continue at point D. If the boiler control light is set as determined by block 348, then the boiler control speed signal is checked against out-of-limit values and if not in-limits, the transfer path 243 is performed using functional block 350. Otherwise, the boiler control override pushbutton is monitored for depression by functional block 351 and the boiler control permissive contact 76 is monitored by decisional block 352. If the boiler control override pushbutton is depressed, or if the boiler control permissive contact 76 opens during boiler control mode operation, then functional block 350 is executed and program execution continues at point D. Should none of the conditions of the boiler control speed signal be out-of-limit, the boiler control override pushbutton be depressed or the boiler control permissive contact 76 be open exist, then the boiler control lamp remains backlighted by functional block 353 with program execution continuing again at point D.

Referring back now to decisional block 346 in the flowchart of FIG. 9B, if the boiler feedpump turbine control system is operating in the boiler control override mode as determined by functional block 356, then the boiler control override pushbutton is monitored by block 354 and a speed reference value is compared with the boiler control speed signal by functional block 355 and the boiler control permissive contact 76 is monitored by block 356. Should the boiler control override pushbutton not be depressed, or should the speed reference value be less than the boiler control set point, or should the boiler control permissive contact be open, then the boiler feedpump turbine control system 40 will remain operating in the boiler control override mode with the boiler control override light being set by block 334. Accordingly, should the boiler control override pushbutton be depressed and the speed reference be less than the boiler control set point and the boiler control permissive contact 76 be closed, then the boiler feedpump turbine control system 40 will be transferred to the speed setter control mode with the speed setter light being backlighted and the boiler control override light be turned off by functional block 358.

The flowchart previously described in connection with FIG. 9B illustrates the transfers between the various modes. For example, the transfer between the speed setter control mode 230 and the boiler control mode 240 of FIG. 7 may be preformed as exhibited by functional blocks 336, 337, 340, 342 and 343 of FIG. 9B. In addition, the transfer between the speed setter control mode block 230 and the boiler control mode override block 242 along path 245 may be conducted as exhibited by functional blocks 336, 337 and 338 of FIG. 9B. Further, the transfer between the boiler control mode 240 and the boiler control override mode 242 along path 243 as shown in FIG. 7, may be conducted as exhibited by functional blocks 348, 349 and 350 or 348, 349, 351 and 350 or 348, 349, 351, 352 and 350 as shown in FIG. 9B. Still further, the boiler control override mode transfer to the speed setter control mode along path 244 as shown in FIG. 7, may be conducted as shown using functional blocks 346, 354, 355, 356 and 358 of FIG. 9B. FIG. 9B additionally exhibits the logic of the permissives which may allow a transfer to occur.

Figure 9C:
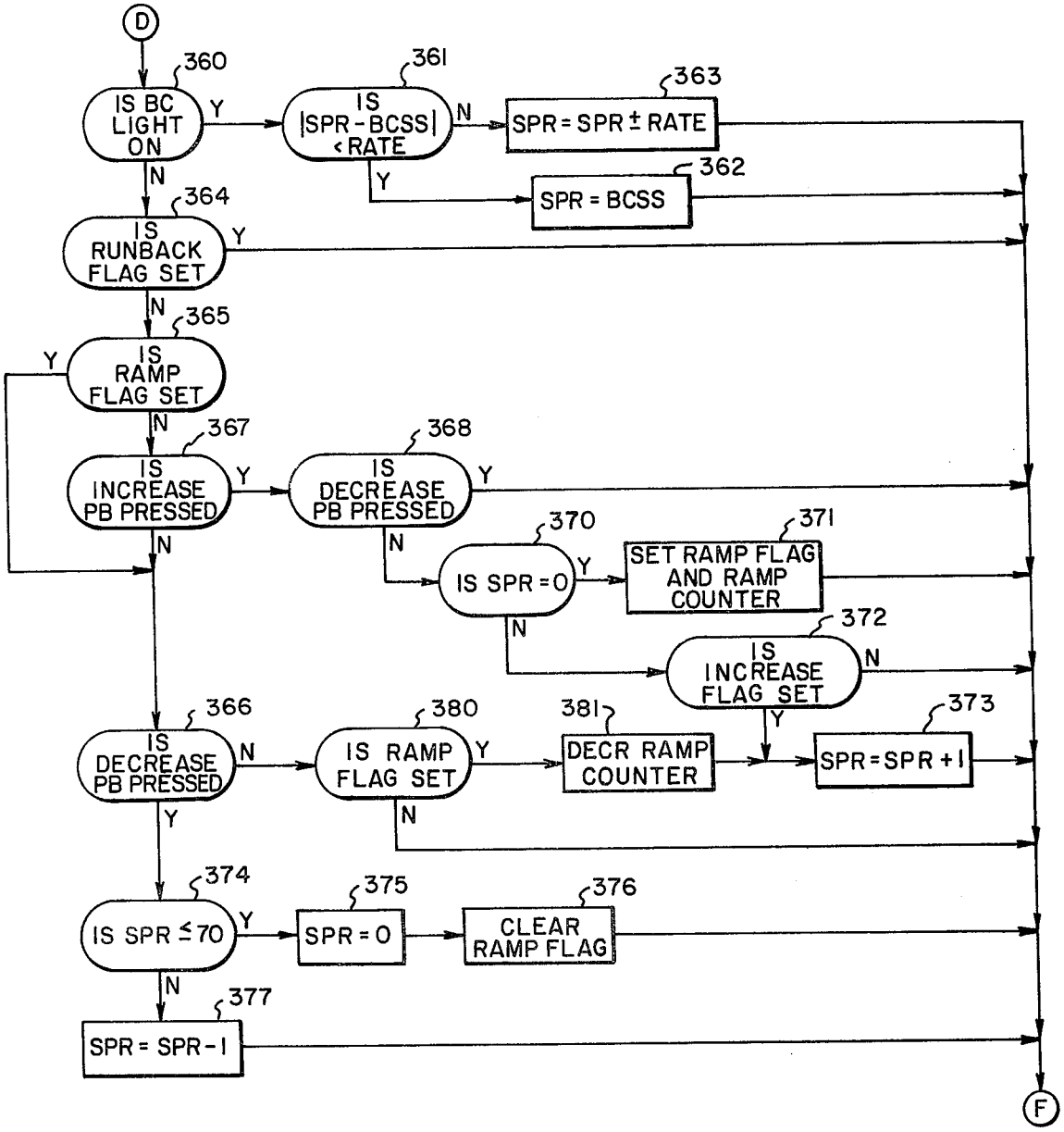
Figure 9D:
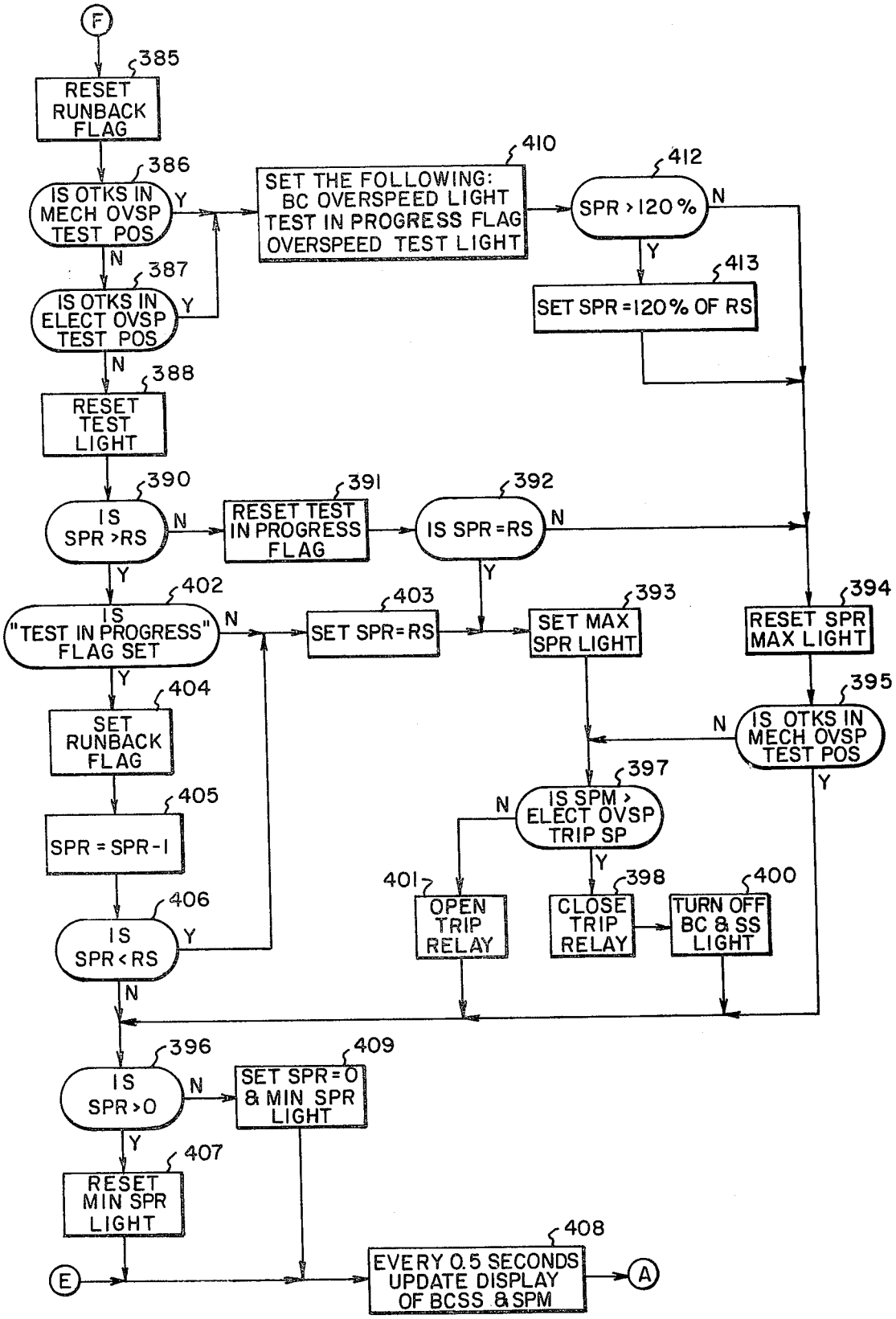

Starting at reference point D as shown in the flowchart of FIG. 9C, functional block 360 determines if the boiler control speed signal is controlling the speed reference set point. If the boiler control mode is operational, then a small subroutine comprising the functional block 361, 362 and 363 are next executed as an example of regulating the rate of change of the boiler control speed signal. The functional block 361 monitors the rate of the boiler control speed signal as provided by the boiler feedwater control system 42. Should the rate be less than a predetermined value, then the new speed reference will be equated to the present boiler control speed signal by functional block 362. Otherwise, the speed reference will be increased only by a predetermined amount, thus ignoring the present value of the boiler control speed signal using functional block 363. In either case, program execution continues at point F. If not in the boiler control operational mode as determined by functional block 360, a runback flag is monitored by functional block 364 next in sequence. If the runback flag is set, program execution is continued at point F in the flowchart of FIG. 9C and the remaining functions are bypassed.

The runback flag is associated with the overspeed test of functional block 262 of FIG. 8. It corresponds to running back the speed reference from a value greater than the rated speed of the boiler feedpump turbine if the speed reference should be left at a value greater than the rated speed of the boiler feedpump turbine upon completion of the overspeed test (i.e., the overspeed test engable signal is no longer present). This will be described in further detail hereinbelow.

Should the runback flag not be set, a ramp flag is next monitored by functional block 365. Should the ramp flag be set, program execution will continue at functional block 366. Otherwise, the increase pushbutton is monitored by functional block 367. If the increase pushbutton is not depressed, program execution will also continue at functional block 366. If the increase pushbutton is depressed, the state of the decrease pushbutton is next monitored by functional block 368. Should both the increase and decrease pushbuttons be depressed, no further action will be taken and program execution will continue at point F. If the increase pushbutton is individually depressed, then the value of the speed reference is monitored by functional block 370. If the speed reference value is equal to zero, the ramp flag and ramp counter will be set by block 371. Otherwise, the increase flag will be monitored by functional block 372. The increase flag of course will be set corresponding to the depression of the increase pushbutton, the event of which is established by functional block 367. If the increase flag is set, the speed reference will be incremented by one count by block 373 in accordance with a predetermined rate. Otherwise, the program execution will be continued at point F without incrementing the speed reference.

Referring back now to functional block 366 where the decrease pushbutton is monitored, should the decrease pushbutton be depressed and the speed reference be less than a minimum predetermined value, generally 70 rpm, as determined by functional block 374, then the speed reference will be equated to zero and the ramp flag will be cleared by functional blocks 375 and 376, respectively. If the decrease pushbutton is depressed and the speed reference is greater than 70 rpm, then the speed reference will be decremented by one count by functional block 377 in accordance with a predetermined rate. Thereafter, program execution will continue at point F. Should the decrease pushbutton not be depressed as monitored by functional block 366, and the ramp flag set as determined by functional block 380, then the ramp counter will be decremented by functional block 381 and the speed reference will be incremented by one count by functional block 373. If the decrease pushbutton is not depressed and if the ramp flag is not set, program execution will continue at point F.

Starting at point F in connection with the description of FIG. D, the runback flag is reset by the instruction 385 and the overspeed test switch 264 is monitored by decisional block 386 for a mechanical overspeed test and 387 for an electrical overspeed test. Should the overspeed test switch 264 be not in a test position as determined by blocks 386 and 387, the test light will be turned off by block 388 and the speed reference will be compared with a rated speed value in decisional block 390. If the speed reference is less than or equal to the value of the rated speed of the turbine as determined by functional block 390, the test and progress flag will be reset by functional block 391 and further if the speed reference is found to be equal to the rated speed value as determined by functional block 392, a maximum speed reference light located on the operator's control panel 41 will be backlighted by functional block 393. If the speed reference is found to be less than the rated speed value as determined by functional block 392, the speed reference maximum light will be turned off by functional block 394 and the overspeed test switch will be again monitored by functional block 395. If the overspeed test is being conducted, program execution will continue at functional block 396. Otherwise, the instantaneous speed measurement as calculated by the functional block 321 described above is compared with an electrical overspeed trip set point value in functional block 397. Typically, this trip value is 110% of rated turbine speed. If the instantaneous speed measurement value exceeds the electrical overspeed trip set point value, the relay T will be energized by block 398 and the boiler control and speed setter lamps on the operator's control panel 41 will be turned off by functional block 400. Program execution will then continue at functional block 396. If the speed measurement is less than or equal to the electrical overspeed trip set point value, the relay T will be deenergized by the functional block 401 with the program execution again continuing at functional block 396.

Referring back to functional block 390 where the speed reference is compared with the rated speed value, should the speed reference be greater than the rated speed value and a test in progress flag not be set as determined by functional block 402, then the speed reference will be set equal to the rated speed value by functional block 403 and the sequence of functional blocks starting at 393 will be executed thereafter. Should the speed set point reference be determined greater than the rated speed value and the test in progress light be set as determined by functional blocks 390 and 402, respectively, then the runback flag will be set by functional block 404. The speed reference will be decremented by one count by functional block 405 and the speed reference will again be compared with the rated speed value by functional block 406. If the speed reference value is still greater than the rated speed value as determined by functional block 406, the value of the speed reference will next be compared with zero using functional block 396. If the speed reference is greater than the zero value, the minimum speed reference light located on the operator's control panel 41 will be reset by functional block 407 and a display of the boiler control speed signal and the measured turbine speed will be updated every one-half second by functional block 408. Program execution will then be continued at point A. Should the speed reference be equal to zero or less than zero, as determined by functional block 396, speed reference will be set equal to zero and the minimum speed reference light will be backlighted by functional block 409 and program execution will continue at functional block 408. If the speed reference determined to be greater than or equal to the rated speed as determined in the sequence of functional blocks 402, 404, 405 and 406, program execution will then continue at functional block 403.

Referring back now to the functional blocks 386 and 387 where the overspeed test switch is monitored, should the overspeed test switch 264 be in the test position, the instructions connected with functional block 410 will be executed. The instructions associated with functional block 410 will backlight the boiler control override lamp corresponding to activating the boiler control override operational mode, set the test in progress flag which corresponds to being in the overspeed test mode and backlight the overspeed test lamp located on the operator's control panel 41. Then, in functional block 412, the speed reference value is compared with a value, typically set at 120% of rated speed. Functional blocks 412 and 413 insure that the speed reference value will not exceed the 120% of rated speed value. Program execution then continues at functional block 394. The flowchart described in connection with FIG. 9D comprises essentially those functions which are connected with the functional block overspeed test limiter 262 as described in connection with FIG. 8.

The previously described functional blocks starting at 320 through functional block 413 may be for the purposes of this embodiment executed only during the even periods of the real time clock. Those functional blocks associated with FIG. 9E may be executed for the purposes of this embodiment only during the odd periods of the real time clock, thus distributing the processing time associated with the execution of the instructions preprogrammed in the ROM's 60–63 by the microprocessor 64.

Figure 9E:
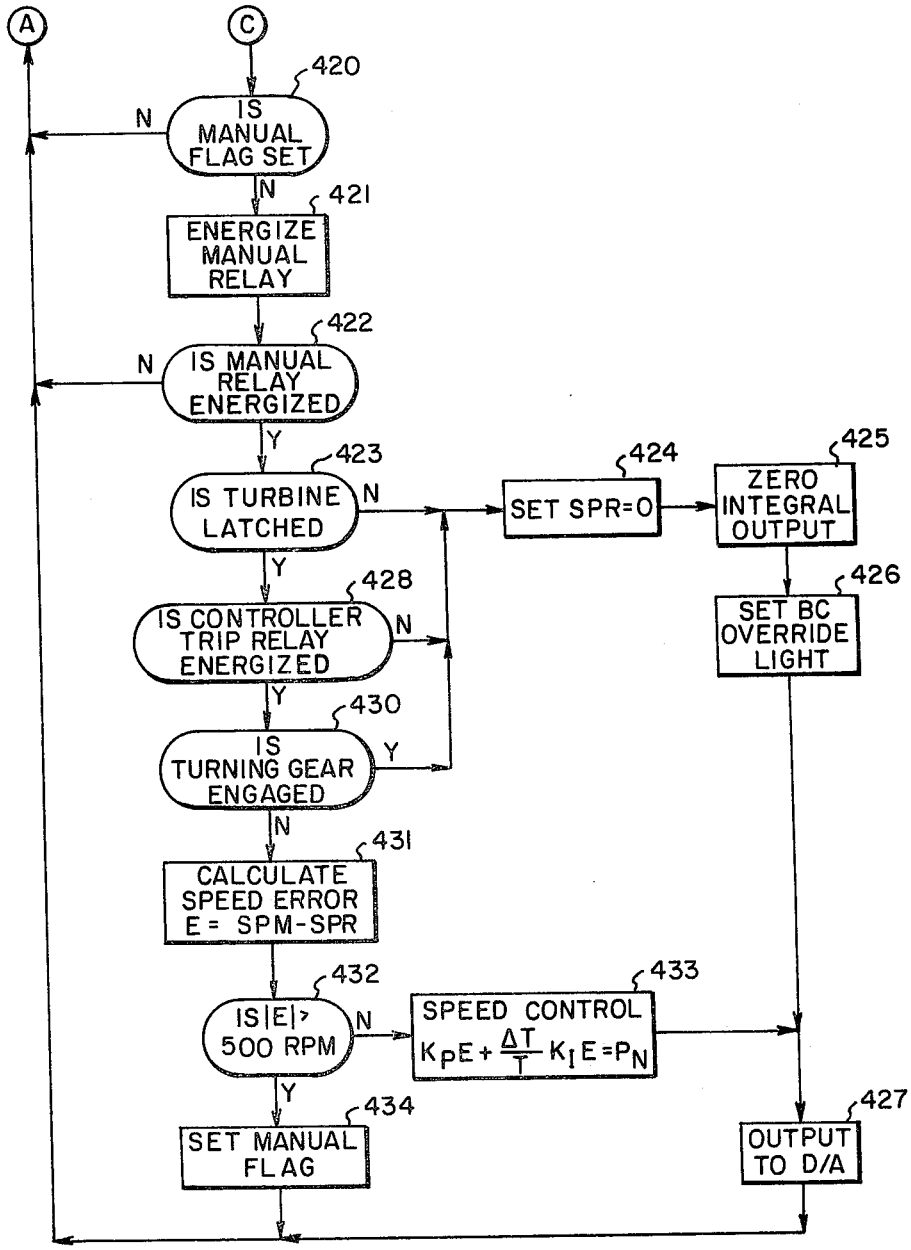

The functional blocks which will be described in connection with FIG. 9E below substantially correspond to those functions associated with the proportional plus integral speed control function 265 shown in connection with FIG. 8. Starting at point C, the manual flag is monitored by functional block 420. If the manual flag has not been set, an attempt will be made to energize the relay $\overline{MAN}$ which is associated with functional block 274 of FIG. 8 using signal line 113. The relay $\overline{MAN}$ is monitored by functional block 422 using the $\overline{MAN1}$ relay contact. If the manual flag is set or if the relay $\overline{MAN}$ is not energized, program execution will be continued at point A where the microprocessor 64 will sit in a wait for interrupt loop anticipating the next real time clock interrupt signal. Should the relay $\overline{MAN}$ be energized, the instructional program next determines if the turbine hydraulic pressure is operational by monitoring the relay contact TT3. If the hydraulic pressure has not yet come up to its operational value or for some reason the turbine system has been tripped causing the hydraulic pressure to fall below its operational value, the turbine hydraulic system will be considered not latched by functional block 423 and the functional blocks 424, 425 and 426 will be sequentially executed to equate the speed reference signal to zero, to equate the integral ouput of the proportional plus integral speed control function 265 to zero and to revert the boiler feedpump turbine control system 40 to the boiler control override mode by setting the boiler control override light, respectively. The output of the proportional plus integral speed control function 265 will next be transferred to the position control signal D/A converter 85 by executing the functional block 427. Program execution will next be continued at point A.

Should the turbine be identified as being latched by functional block 423, the relay CT is monitored using relay contact CT2 by functional block 428 and the turning gear engaged contact is monitored by functional block 430. Should the relay CT not be energized or if the turning gear is still engaged as determined by the functional blocks 428 and 430, the program execution will continue at functional block 424. Accordingly, if the relay CT be energized and the turning gear be disengaged, the proportional plus integral speed control function calculation shall be enabled in accordance with the following functional blocks 431, 432, 433, and 434. In functional block 431 the algebraic value of the speed error is calculated by subtracting the speed reference value from the present speed measurement calculated value. Next, the calculated speed error is compared with a value of speed error, typically 500 rpm, which would indicate an anomaly condition. If the speed error should exceed this 500 rpm value as determined by functional block 432, the manual flag will be set by functional block 434 and program execution will continue at point A. Otherwise, the proportional plus integral speed control algorithm as shown in functional block 433 will be conducted to effect an instantaneous position control signal which will be transferred to the position control signal D/A converter 85 using functional block 427. Program execution will then again be continued at point A.

It is understood that the sequence of functions described in connection with FIGS. 9A–9E shown above exemplify but one sequence of preprogramming instructions in the ROM modules 60–63 to be executed by the microprocessor 64 in accordance with the principles and scope of the invention. While for this embodiment it is shown that the programs are executed during odd and even periods of the real time clock, other microprocessor processing time schedules may also be implemented without deviating from the principles of the invention. It is further understood that while the invention has been described in connection with an embodiment using a microprocessor and preprogrammed ROM modules, other means such as a minicomputer or analog and digital design embodiments may be also used to implement the functions described in connection with FIG. 8 without taking away from the broad scope of the invention. The embodiment described above has been implemented in connection with a microprocessor based boiler feedpump turbine control system in compliance with the best mode requirements of the statutes.

We claim:

1. A boiler feedpump turbine (BFPT) system for controlling the flow of feedwater pumped by a boiler feedpump from a feedwater source to a boiler comprising:

a source of steam;

a boiler feedpump turbine mechanically coupled to the boiler feedpump for governing the flow of feedwater pumped thereby as a function of the rotational speed of the turbine;

at least one steam admission valve for governing the steam admission to the boiler feedpump turbine from the source of steam to generate a rotational speed therein, said rotational speed being a function of the position of the steam admission valve;

means for generating a boiler control turbine speed signal representative of the boiler control requirement for feedwater flow;

means for generating a turbine speed demand signal;

means for controlling the turbine speed in one of at least three modes by controlling the position of the at least one steam admission valve as a function of a speed set point, said at least three modes including:

(a) a first mode having the speed set point controlled by the turbine speed demand signal only at values of the speed set point which are below the boiler control turbine speed signal value;

(b) a second mode having the speed set point controlled by the boiler control turbine speed signal; and (c) a third mode having the speed set point controlled by the turbine speed demand signal to override the boiler control turbine speed signal; and means for automatically transferring between any two of the three modes without causing significant disturbance in the boiler feedpump feedwater flow.

2. The BFPT system according to claim 1 wherein the transfer from the first mode to the second mode is governed by an initial event of substantially equating the turbine speed demand signal to the boiler control turbine speed signal; and wherein subsequent to the initial event, the turbine speed demand signal is tracked to the boiler control speed signal while the controlling means is operating in the second mode.

3. The BFPT system according to claim 1 including:

an activating means for generating a first signal to initiate a mode transfer;

means for generating a second signal representing the condition of the boiler control speed signal value being outside of a predetermined range of values;

means for generating a third signal representing the condition of the boiler control speed signal rendered invalid;

wherein the transfer from the second mode to the third mode is generated by one of either the first, second and third signals;

wherein the transfer from the first mode to the third mode is generated by the first signal; and wherein the transfer from the third mode to the first mode is generated by the first signal only with the condition that the speed demand signal is less than the boiler control speed signal.

4. The BFPT system according to claim 1 including a means for generating a signal representative of the actual speed of the boiler feedpump turbine; wherein the position of the at least one steam admission valve is also controlled as a function of the signal representative of the actual turbine speed; and wherein the actual turbine speed signal generating means includes:

primary and secondary speed transducers for generating signals representative of the actual turbine speed;

switching means for selecting one of either the primary and secondary speed transducer signals for use by the turbine speed controlling means;

means for generating a first malfunction signal representative of the condition of a malfunction in the primary speed transducer;

means for generating a second malfunction signal representative of the condition of a malfunction in the secondary speed transducer; and means for controlling the selection of the switching means as a function of the first malfunction signal; and means governed by the first and second malfunction signals to provide an indication of a speed transducer malfunction.

5. The BFPT system according to claim 1 wherein the turbine speed controlling means includes a closed-loop turbine speed controller operative as a proportional plus integral function and governed by the speed set point and an actual speed signal to generate a valve position demand signal, said turbine speed controller having adjustable proportional and integral gain constants.

6. The BFPT system according to claim 5 further comprising a manual turbine speed controller operative, at times, to control the valve position demand signal of the at least one steam admission valve independently of the closed-loop turbine speed controller, said manual controller being automatically rendered operative as governed by a detected malfunction in the closed-loop turbine speed controller.

7. The BFPT system according to claim 1 wherein the turbine speed controller further comprises an overspeed test means which is activated by an overspeed test signal and is operative upon activation to permit the speed demand signal to control the speed set point within a predetermined speed range greater than a rated speed value of the boiler feedpump turbine; and wherein the speed set point is permitted to remain above the rated speed value only when the overspeed test means is activated by the overspeed test signal.

8. The BFPT system according to claim 1 wherein the functions of the speed demand signal generating means, the controlling means, the actual speed signal generation means and the transferring means are all substantially implemented by a microprocessor-based control system comprising:

a first memory permanently programmed with addressably order sets of instructions and data words for characterizing the operations of the aforementioned means;

a system clock;

a microprocessor bus;

a microprocessor for processing the instructions and data words of the first memory as governed by the system clock to perform the function of said aforementioned means, said microprocessor and first memory being both coupled to the microprocessor bus for conducting the instruction and data words therebetween;

means coupled to the microprocessor bus for interfacing input and output signals which are respectively coupled to and from the microprocessor;

a second memory coupled to the microprocessor bus, for temporarily storing processed data words from the microprocessor.

9. The BFPT system according to claim 8 further comprising a real time clock; and wherein selected instructions and data words of the first memory are processed by the microprocessor in accordance with periods of the real time clock.

10. A boiler feedpump turbine (BFPT) system for controlling the flow of feedwater pumped by a boiler feedpump from a feedwater source to a boiler comprising:

a source of steam;

a boiler feedpump turbine mechanically coupled to the boiler feedpump for governing the flow of feedwater pumped thereby as a function of the rotational speed of the turbine;

at least one steam admission valve for governing the steam admission to the boiler feedpump turbine from the source of steam to generate a rotational speed therein, said rotational speed being a function of the position of the steam admission valve;

means for generating a signal representative of the actual turbine speed;

first means governed by the signal representative of the actual turbine speed and a predetermined turbine speed set point to generate a first position set point signal;

second means governed by a position demand signal to generate a second position set point signal;

means for selecting one of either the first and second position set points; and means governed by the selected position set point to control the at least one steam admission valve to a position designated by the position set point.

11. The BFPT system according to claim 10 wherein the selecting means is operative to transfer selection from the first to the second position set points upon detection of a malfunction in the operation of the first means.

12. The BFPT system according to claim 10 wherein there occurs no substantial change in the valve position of the at least one steam admission valve when the selecting means transfers selection between the first and second position set points, whereby there is no disturbance in feedwater flow as a result of a transfer in selection of valve position set points.

13. A boiler feedpump turbine (BFPT) overspeed test system for permitting the rotational speed of a boiler feedpump turbine to be controlled in a predetermined speed range above a rated turbine speed value for testing a turbine overspeed trip system associated with the BFPT, said test system comprising:

a source of steam;

a boiler feedpump turbine mechanically coupled to the boiler feedpump for governing the flow of feedwater pumped thereby as a function of the rotational speed of the turbine;

at least one steam admission valve for governing the steam admission to the boiler feedpump turbine from the source of steam to generate a rotational speed therein, said rotational speed being a function of the position of the steam admission valve;

first means governed by a turbine speed reference signal to control the rotational speed of the boiler feedpump turbine in a predetermined speed range above a rated turbine rotational speed by positioning the at least one steam admission valve only when said first means is enabled by an overspeed test enable signal;

second means for automatically decreasing the turbine speed reference signal at a predetermined rate to converge it to the rated turbine speed value at times when the turbine speed reference signal is greater than the rated turbine speed value and the first means is no longer enabled by the overspeed test enable signal, whereby the boiler feedpump turbine may be operated above a rated speed value only when an overspeed test is in progress.

14. A method for overriding the speed control of a boiler feedpump turbine by a boiler feedwater demand signal comprising the steps of:

generating a turbine speed reference signal independent of the boiler feedwater demand signal;

generating, at times, a boiler control override command signal;

generating an out-of-range signal indicating that the boiler feedwater demand signal is outside a predetermined signal range;

generating an error signal indicating that the boiler feedwater demand signal is invalid;

exclusively selecting one of either the boiler feedwater demand signal and the turbine speed reference signal for control of the rotating speed of the boiler feedpump turbine; and automatically transferring the selection of the boiler feedwater demand signal to the turbine speed reference signal for control of the rotating speed of the boiler feedpump turbine when any one of the boiler override command signal, out-of-range signal and error signal is generated.

15. The method of claim 14 including the step of tracking the turbine speed reference signal to the value of the boiler feedwater demand signal when the speed of the boiler feedpump turbine is controlled by the boiler feedwater demand signal.

16. The method of claim 14 including the step of regulating the rate of change of the boiler feedwater demand signal when the speed of the boiler feedpump turbine is controlled by the boiler feedwater demand signal.

17. The method of claim 14 wherein the step of automatically transferring the selection is performed without effecting a substantial change in the rotating speed of the boiler feedpump turbine.

18. The method of claim 14 including the step of limiting the value of the selected one of the boiler feedwater demand signal and the turbine speed reference signal to a rated turbine speed value.

19. The method of claim 18 including the steps of:

generating, at times, an overspeed test enable signal;

automatically transferring the selection of the boiler feedwater demand signal to the turbine speed reference signal for controlling the speed of the boiler feedpump turbine when the overspeed test enable signal is generated; and permitting the control of the rotating speed of the boiler feedpump turbine by the turbine speed reference signal in a predetermined speed range above the rated speed value when the overspeed test enable signal is generated.

20. The method of claim 19 including the step of automatically decreasing the turbine speed reference signal at a predetermined rate converging it to the rated turbine speed value when the turbine speed reference signal is greater than the rated turbine speed value and the overspeed test enable signal is no longer generated.

21. A method for controlling the flow of feedwater pumped by a boiler feedpump from a feedwater source to a boiler comprising the steps of:

governing the flow of feedwater pumped by a boiler feedpump as a function of the rotational speed of a boiler feedpump turbine which is mechanically coupled to the boiler feedpump;

generating a source of steam;

governing the steam admission to the boiler feedpump turbine from the generated source of steam using at least one steam admission valve to generate a rotational speed in the boiler feedpump turbine as a function of the steam flow position of the at least one steam admission valve;

generating a boiler control turbine speed signal representative of the boiler control requirement for feedwater flow;

generating a turbine speed demand signal;

controlling the position of the at least one steam admission valve as a function of a speed set point;

adjusting the speed set point as a function of the generated turbine speed demand signal only at speed set point values below the value of the generated boiler control turbine speed signal;

transferring adjustment of the speed set point from a function of the turbine speed demand signal to a function of the generated boiler control turbine speed signal when the value of the speed set point is initially adjusted substantially equal to the value of the generated boiler control turbine speed signal; and automatically overriding the adjustment of the speed set point as a function of the generated boiler control turbine speed signal in response to an override command to permit the adjustment of the speed set point as a function of the generated turbine speed demand signal beyond the value of the generated boiler control turbine speed signal.

22. The method in accordance with claim 21 wherein the step of automatically overriding is performed in response to any one of the following steps:

determining that the boiler control turbine speed signal is outside of a predetermined range of values;

determining that the boiler control turbine speed signal is invalid;

generating an override command signal; and generating an overspeed test enable signal.

* * * * *